US009995297B2

(12) United States Patent
Jackle et al.

(10) Patent No.: US 9,995,297 B2
(45) Date of Patent: Jun. 12, 2018

(54) PUMP SYSTEM

(75) Inventors: Michael Jackle, Hilzingen (DE); Christian Hopf, Muhlhausen-Ehingen (DE)

(73) Assignee: ALLWEILER GMBH, Radolfzell (DE)

( * ) Notice: Subject to any disclaimer, the term of this patent is extended or adjusted under 35 U.S.C. 154(b) by 760 days.

(21) Appl. No.: 14/113,666

(22) PCT Filed: Apr. 26, 2012

(86) PCT No.: PCT/EP2012/057664
§ 371 (c)(1),
(2), (4) Date: Oct. 24, 2013

(87) PCT Pub. No.: WO2012/146662
PCT Pub. Date: Nov. 1, 2012

(65) Prior Publication Data

US 2014/0056720 A1 Feb. 27, 2014

(30) Foreign Application Priority Data

Apr. 29, 2011 (DE) ..... 10 2011 050 018

(51) Int. Cl.
*F04B 49/06* (2006.01)
*F04B 17/03* (2006.01)
(Continued)

(52) U.S. Cl.
CPC ..... *F04B 49/06* (2013.01); *F04B 17/03* (2013.01); *F04B 49/065* (2013.01); *F04C 2/16* (2013.01);
(Continued)

(58) Field of Classification Search
CPC ..... F04B 49/06; F04B 17/03; F04B 49/065; F04B 2203/0204; F04C 14/06; F04C 2/16;
(Continued)

(56) References Cited

U.S. PATENT DOCUMENTS 6,097,171 A 8/2000 Branecky
6,360,717 B1 * 3/2002 Chang ..... F02M 57/025 123/381
(Continued)

FOREIGN PATENT DOCUMENTS

CN 201363264 Y 12/2009
DE 202005001746 12/2005
(Continued)

OTHER PUBLICATIONS

International Search Report dated Mar. 14, 2013 for PCT/EP2012/057664 Filed Apr. 26, 2012.

*Primary Examiner* — Thomas C Lee
*Assistant Examiner* — Alan Chu

(57) ABSTRACT

The invention relates to a pump system comprising a positive-displacement pump module, preferably a screw pump, a drive module which can be exchanged separately from the positive-displacement pump module, said drive module comprises an electric drive motor and a frequency converter associated therewith for controlling or adjusting a drive motor speed, control means comprising a controller for producing an adjustment variable ($Y_s$) for the frequency converter in accordance with a reference variable (W) and a first actual operational parameter (X) and logistic means associated with the controller, and reference variable defining means for providing the reference variable (W) for the control means. According to the invention, the control means are provided in a control module separately from the drive module, and the drive module can be exchanged separately from the control module, and the drive module does not have a designed and/or controlled controller for producing the adjustment variable ($Y_s$).

20 Claims, 10 Drawing Sheets

(51) Int. Cl.
*F04C 2/16* (2006.01)
*F04C 14/06* (2006.01)

(52) U.S. Cl.
CPC ..... *F04C 14/06* (2013.01); *F04B 2203/0204* (2013.01); *F04C 2240/403* (2013.01); *F04C 2240/70* (2013.01); *F04C 2240/81* (2013.01); *F04C 2270/0525* (2013.01)

(58) Field of Classification Search
CPC ..... F04C 2240/81; F04C 2240/70; F04C 2270/0525; F04C 2240/403
USPC ..... 700/282
See application file for complete search history.

(56) References Cited

U.S. PATENT DOCUMENTS

2004/0084179 A1 5/2004 Watson et al.
2007/0248468 A1* 10/2007 Holmberg ..... F04D 15/0066 417/44.2
2008/0226464 A1* 9/2008 Livoti ..... F04B 17/04 417/44.1
2008/0294382 A1* 11/2008 Lim ..... H01L 21/67288 702/185
2009/0005615 A1* 1/2009 Hassan ..... B01F 7/00766 568/939
2009/0081050 A1* 3/2009 Moore ..... F04D 7/045 417/44.11
2009/0204245 A1* 8/2009 Sustaeta ..... G05B 13/024 700/99
2009/0220352 A1 9/2009 Carstensen
2011/0082569 A1* 4/2011 Bellville ..... G05B 19/0426 700/79
2011/0098931 A1* 4/2011 Kosmala ..... E21B 47/00 702/12
2011/0166689 A1* 7/2011 Alden ..... G05B 15/02 700/108
2012/0221212 A1* 8/2012 Peterson ..... F15B 11/165 701/50

FOREIGN PATENT DOCUMENTS

DE 202005001746 U1 12/2005
DE 102008063927 A1 6/2009
JP 2000137010 A 5/2000
JP 2000283056 A 10/2000
JP 2001012379 A 1/2001
JP 2003077907 A 3/2003
TW 200942695 A 10/2009
WO 2009/103138 A2 8/2009

* cited by examiner

PUMP SYSTEM

CROSS-REFERENCE TO RELATED APPLICATIONS

This is a national stage application of pending international application serial number PCT/EP2012/057664, titled "Pump System," having an international filing date of Apr. 26, 2012, and which claims priority to German national patent application serial no. 10 2011 050 018.9, filed Apr. 29, 2011, the entirety of which applications are expressly incorporated by reference herein.

FIELD

The invention relates to a positive displacement pump system, and more particularly to a system for regulating or adjusting a drive motor rotational speed for use with a positive displacement pump.

BACKGROUND

Today's positive displacement pump motors for driving positive displacement pumps comprise a frequency converter having an integrated regulator capable of regulating the input signal, in particular a voltage signal for the frequency converter as a function of a measured actual operating parameter and a reference input variable to be achieved. The regulator sends "without criticism" the manipulated variable, which is determined as a function of the reference input variable, to the frequency converter. One problem is that today, a regulator assigned to a frequency converter is designed only for each specific motor, i.e., it is not optimized with regard to the positive displacement pump, which is actually of interest with positive displacement pump systems. This can lead to problems in the case of positive displacement pump systems because positive displacement pumps are fundamentally a greater threat to the pump itself and/or to other process units in comparison with rotary pumps. This can be attributed to the difference in the characteristic response of positive displacement pumps in comparison with turbo engines. Fundamentally, this may also lead to complete self-destruction or permanent damage to the positive displacement pumps in the extreme case, in particular when signs of damage are not detected promptly.

This also does not take into account the influence of manipulated variable signals, resulting directly from the reference input variable (setpoint input), on the quality of the delivery fluid with known positive displacement pumps.

In addition, one disadvantage of known pump systems is that specific programming of the logic unit of the control means must be performed on the respective electric drive motor, including the frequency converter, but such programming can only be a compromise from the standpoint of optimized properties of the pump module. With known pump systems, it is only possible to replace the drive module independently of the pump module—it is impossible to replace the control means because the control means are integrated into the frequency converter of the electric motor.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Starting from the aforementioned prior art, the object of the present invention is to provide a pump system which will guarantee an increased security for other process units and for the pump module itself. In addition, variability for the final customer should be increased and a rotational speed control that has been optimized from the standpoint of optimal functionality and a long service life of the pump module should be possible.

All combinations of at least two of the features disclosed in the description, the claims and/or the figures fall within the scope of invention. To avoid repetition, features disclosed according to the device should be considered as having been disclosed according to the process and claimable as such. Likewise, features disclosed according to the process should also be disclosed and claimable as device features.

The present invention is based on the idea of separating the control means, which have previously been integral in the frequency converter, to obtain a control module that is separate from the drive module, i.e., is independent, and in which the logic means are optionally provided with a database and a regulator, preferably embodied as a PI regulator or a PID regulator, to then be able to supply an input signal (manipulated variable) for the frequency converter as a function of a reference input variable and at least one actual operating parameter (actual system parameter) and thus independently of the frequency converter, such that the input signal is then converted by the drive module or more specifically by its frequency converter through a corresponding energization of the winding into a motor rotational speed. Through the present invention, it is thus possible for the first time to replace and/or freely select the drive module easily and independently of the control means for generating the setpoint rotational speed signal. The invention thus makes it possible to use frequency converters of a very simple design, which in the simplest case act as controllers that adjust the setpoint rotational speed signal predetermined by the separate control module on the motor, which is designed as an asynchronous motor, for example, through appropriate influencing on the electric current. It is of course also possible to use "intelligent" frequency converter, such as those used previously, although they are then preferably not used, i.e., controlled in the previous manner. Any PI regulator or PID regulator of the converter, which might be present, is thus preferably not acted upon by a pressure sensor signal and not by a flow rate signal and not by a vibration sensor signal and not by a temperature sensor signal and also not by a torque sensor signal, where the goal is to generate a manipulated variable, in particular in the form of a rotational speed setpoint signal on the basis of this input—and instead this manipulated variable is received by the separate control module and converted by the frequency converter into a motor rotational speed in an essentially known manner.

In addition to the simplified replaceability of the drive module independently of the actual control (control means and/or control module) for generating the manipulated variable to be converted by the frequency converter (optionally a corrected manipulated variable, as will be explained below), the positive displacement pump system designed according to the concept of the present invention also has other important advantages. It is thus possible for the first time to use a logic unit (logic means) optimized specifically for the pump module and having suitable pump module-specific software as well as a regulator, preferably an optimally selected PI regulator or PID regulator that is optimized for the actual pump process. Software tailored specifically for the given pump module is preferably provided for the logic unit, which comprises a microcontroller in particular, so that the actual drive motor can be replaced independently of the pump module and independently of the control module without having any effect on the configuration of the pump module via the control module. Alternatively, it is conceivable to provide different software for different pump modules or to provide a comprehensive software, in which it is possible to select the respective pump module used in a given case, but preferably a suitable menu control can be selected. No specific adaptation of the control module to the respective pump module being used, i.e., no change in the hardware, is necessary.

The control module offers for the first time the possibility of monitoring the pump module, if necessary, even independently from any control room, regardless of the design of the drive module, and to regulate it through rotational speed regulation such that the logic is preferably designed to detect unacceptable operating conditions (unacceptable actual system parameters) and to return the pump module back to a safe operating point, optionally through adjustment of the setpoint rotational speed to be set by the frequency converter, and to do so by reducing the setpoint rotational speed of the input signal for the frequency converter.

The logic unit is preferably designed so on detection of a critical actual system parameter (in particular by comparison with limit values stored in this database), it stipulates a safe setpoint rotational speed and/or a manipulated variable that is stored in a database in particular and will preferably prevent (further) damage to the pump module or an adapted setpoint system parameter is output to this logic unit, and on the basis of this the integral regulator of the control module outputs a setpoint rotational speed as the manipulated variable, preferably a lower speed. The setpoint rotational speed predefined by the logic unit may be zero in the extreme case but it is preferably in a rotational speed range greater than zero, so that the actual process can continue despite the actual critical system parameter. By using the control module designed according to the concept of the present invention, a sudden complete failure with consequences and an optionally resulting production failure and/or loss of production can be minimized.

In a further embodiment of the invention, a higher level control instance (control room) is provided advantageously as the reference input variable specifying means, said control instance being at a higher level than the control module and optionally being used to match a manipulated variable, which is predefined on the basis of an actual operating parameter by the control module (or a corrected manipulated variable to be explained below), for example, so as not to endanger the process as such. In other words, the control room may preferably preselect a different manipulated variable than the one predefined by the control module, in particular a rotational speed stipulation, which is then converted by the frequency converter into a rotational speed of the drive module. In this case, the rotational speed setpoint signal is preferably not regulated in the control module but instead is regulated in the control room. It is also conceivable for the control module to be used by the control room as an auxiliary regulator, such that the setpoint system parameter to be regulated is determined by the control room, so a setpoint system parameter provided by the control module is matched in particular so as not to risk negative effects on the actual process to which the pump module is tied.

The control room and/or the control module is/are preferably designed for output of a start signal and/or a stop signal for the motor of the drive module.

The control module and/or its intelligence (logic) is/are preferably configured so that the main goal pursued is to ensure a long service life of the pump module and/or to avert permanent damage to same. This is implemented advantageously by the fact that if a critical actual operating parameter has been measured and the manipulated variables have been recognized by the logic unit as being critical, either a setpoint rotational speed is stipulated by the logic unit and implemented by the drive module or it is influenced by the logic unit of the system setpoint parameters, with the goal that the regulator of the control module will regulate a lower setpoint rotational speed as a result of this change. However, it may be necessary to ignore the corresponding "proposals" made by the control module and not endanger the process as such while deliberately risking damage to the pump module or at least to maintain this process for a period of time. This control task is then taken over by the control room, which can match the control module from one case to the next and/or under certain predetermined conditions, for example, such that a manipulated variable, which is predefined by the control room, in particular a setpoint rotational speed signal, is sent to the frequency converter of the drive module (where the regulation of this signal is preferably taken over by the control room) and/or through the fact that instead of a manipulated variable, as a function of a measured actual system parameter which is provided directly by the logic unit of the control module as a function of a measured actual system parameter, another (corrected) manipulated variable is preselected by the control room as the input value for the regulator of the control module.

It is most especially preferable if the control module is set up in a different location from the drive unit in a control module housing that is separate from the drive unit and/or the frequency converter, preferably at a minimum distance of 0.5 m, especially 1 m or more. The control module housing preferably has at least one signal input, preferably a digital input for receiving the actual operating parameter, for example, from a sensor module and/or from a control room which is optionally provided. In addition or as an alternative, a signal input, in particular an analog input, is provided for the control module housing for receiving an actual operating parameter and/or a reference input variable from the control room. A manipulated variable output signal output, in particular a rotational speed setpoint signal output is preferably also provided for the housing, so that the manipulated variable degenerated by the regulator of the control module (optionally a corrected manipulated variable) can be output in the direction of the frequency converter of the drive unit and/or a setpoint rotational speed signal can be output in the direction of and/or for the drive unit, said signal being predetermined by the control room, in particular being regulated by it.

In a refinement of the invention, it is advantageously provided that the manipulated variable generated by the regulator as a function of a reference input variable, for example, a setpoint volume flow or a setpoint pressure of the delivery fluid, said manipulated variable preferably being a voltage signal, is not forwarded directly to the frequency converter, i.e., without criticism and/or without a plausibility check, i.e., as an input signal to be checked, but instead to compare the manipulated variable or a corrected manipulated variable, which is to be explained below and is obtained from correction means that are optionally provided in addition, in particular from second correction means or according to a functional relationship from the manipulated variable or the corrected manipulated variable or a reference value according to a functional relationship from the manipulated variable or from the corrected manipulated variable, such that it is compared with at least one first limit value (pump protection limit value), where the at least one first limit value reflects a potential risk for the positive displacement pump and/or another process unit. In other words, going above or below the first limit value would result in a predetermined defect state of the positive displacement pump (with a defined probability). It is advantageous here if the first limit value is not a statistical limit value, i.e., one that is fixedly predetermined and/or defined (where a comparison with such fixed limit values may of course also be performed) but instead is a dynamically determined limit value, which is calculated on the basis of an actual operating parameter. In other words, the limit value is relevantly calculated as a function of several actual operating parameters, i.e., it may be an actual control variable from the controlled system, on the basis of which the regulator determines the manipulated variable and at least one additional actual operating parameter, i.e., another one, which is either measured directly by means of a sensor or is calculated, in particular being simulated on the basis of an actual value. To put it yet another way, the advantage of the invention is that it works not only with static limit values but also the invention takes into account the fact that the limit values are subject to dynamics, i.e., they may change during operation of the positive displacement pump as a function of changing actual operating parameters. For the case when the first (pump protection) limit value thus determined exceeds it or falls below it by a certain measure, a corrected manipulated variable is made available with the help of first correction means, the manipulated variable generated by the regulator or a previously corrected manipulated variable generated by two correction means, for example, is overwritten with the help of the first correction means. It is especially expedient if the corrected manipulated variable assumes the maximum or minimum allowed value, i.e., preferably a first currently calculated limit value, to come as close as possible to the reference input variable, or more precisely, the manipulated variable resulting directly from the reference input variable. In other words, the corrected manipulated variable is a capped variable at the first limit value (preferably a voltage signal which is limited accordingly).

In addition to the comparison of the manipulated variable, a corrected manipulated variable or a reference value currently ascertained with a first limit value that ensures protection of the positive displacement pump, the manipulated variable ascertained by the regulator as a function of the reference input variable or a corrected manipulated variable (for example, a corrected manipulated variable obtained from the first correction means, in particular the corrected manipulated variable output by the first correction means or a currently calculated reference value) is compared with at least one second limit value (delivery fluid protection limit value). Meeting this second limit value and/or failing to meet this limit value should ensure the quality of the delivery fluid. In other words, going beyond the second limit value (with a defined probability) can have a negative effect on a predetermined quality parameter of the fluid delivered with the positive displacement pump. Now if comparator means find that the limit value is exceeded or not met (depending on whether it is a maximum limit value or a minimum limit value) by the at least one second limit value by a predetermined amount, then the second correction means will output a corrected manipulated variable, which is preferably forwarded either directly or indirectly in the form of a comparative value to the comparison with the at least one first limit value or as an input variable (setpoint stipulation) to the frequency converter, the manipulated variable generated by the regulator of the manipulated variable obtained by other upstream correction means, for example, the first correction means, is overwritten with the corrected manipulated variable of the second correction means.

It is also important here that the second limit value is not a fixedly predetermined, stored limit value, but instead is a second limit value that is calculated on the basis of multiple actual current operating parameters, such that the actual operating parameter entering into the calculation is the first actual operating parameter, in particular an actual control variable and in addition is another (additional) measured actual operating parameter or an actual operating parameter calculated on the basis of an actual value. A comparison of a manipulated variable, a corrected manipulated variable, a comparative value and/or an actual operating parameter with a fixed delivery fluid limit value may of course also be performed using a fixed limit value, and if it goes beyond said limit value, the manipulated variable or the corrected manipulated variable may be corrected.

As already indicated, it is within the scope of the present invention to compare a manipulated variable, a corrected manipulated variable or a comparative value either with only at least one first (pump protection) limit value or with only a second (delivery fluid protection) limit value or alternatively to compare it with at least one first (pump protection) limit value and also with at least one second (delivery fluid protection) limit value, whereby again alternatively, the comparison may first be with at least one first limit value and subsequently with at least one second limit value, or conversely, first against a second limit value and then against a first limit value.

It is thus essential to assign a logic unit (logic means) to the regulator for generating a manipulated variable, said logic unit ensuring that the regulator output signal (manipulated variable) is compared first with at least one first limit value and/or at least one second limit value (pump protection limit value and/or delivery fluid protection limit value), such that the at least one first limit value and the at least one second limit value are calculated relevantly, i.e., taking into account a measured or calculated actual operating parameter, and in the event it is detected that the value goes beyond at least one first limit value and/or at least one second limit value, a corrected manipulated variable is generated and then forwarded as an input signal to the frequency converter (frequency transformer) instead of the manipulated variable originally generated by the regulator or instead of an already previously corrected manipulated variable, said frequency converter then energizing the positive displacement pump motor on the basis of this setpoint stipulation.

It is fundamentally possible to implement the logic means in hardware separately from the regulator, for example, in the form of a microcontroller which is separate from the regulator. In a preferred embodiment, the regulator and the control means are implemented by and/or comprise a shared microcontroller.

As will also be explained later, it is especially preferred if positive displacement pump-specific parameters, in particular geometry parameters, such as a clearance measure and/or a spindle diameter also enter into the calculation of the at least one first limit value and/or of the at least one second limit value. In this regard, it is especially expedient if multiple data records of system parameters are stored in a (nonvolatile) memory, in particular in an EEPROM, of the logic means, wherein these data records of system parameters are specific for different positive displacement pumps (i.e., each data record is specific for one type of positive displacement pump), in particular for different models and sizes of positive displacement pumps, and it is expedient if it is possible to select in particular in a basic configuration between these data records, for example, by way of a menu control. It is possible in this way to use the same control means in conjunction with different positive displacement pumps.

The control means make it possible for the first time to detect and optionally counteract possible negative effects in actual changing operating parameters of a reference input variable and/or the effects of a manipulated variable resulting directly from said reference input variable on the intactness of the positive displacement pump and/or on the product quality, i.e., supplying to the frequency converter the quality of the means of the delivery fluid delivered by the positive displacement pump, on the basis of a comparison with a situationally determined limit value, i.e., a limit value that changes over the course of time, and to do so not by converting the manipulated variable (voltage signal) generated by the regulator and resulting directly from the reference input variable by the frequency converter into a positive displacement pump motor rotational speed, as in the past, on detecting a potential threat or by simply turning off the positive displacement pump motor by triggering an electric contactor, but instead by transferring a corrected manipulated variable (preferably larger than zero), which has been increased or reduced in particular as a function of an additional actual operating parameter that is preferably measured. The corrected manipulated variable is preferably the first and a second limit(s) calculated by the first and/or second limit value specifying means provided jointly or alternatively.

The physical variables (parameters) of the pump rotational speed, the delivery fluid viscosity and the delivery fluid pressure are related physically as indicated in the following equation, i.e., are mutually interdependent:

$$n = \left(\frac{p}{k \cdot b \cdot c \cdot v^{a}}\right)^{2},$$

where

- n: pump rotational speed
- p: delivery fluid pressure in the pressure line and/or the delivery fluid pressure difference at the pump,
- exponent a, factors b and c: constants of the positive displacement pump,
- k: factor of the delivery fluid lubrication ability,
- v: delivery fluid viscosity.

According to a preferred exemplary embodiment, it is provided that the control means take into account all the parameters given above for controlling the frequency converter, whereby the pump rotational speed is preferably taken into account in the form of the manipulated variable, the delivery pressure is preferably measured on or near the pressure connection or, alternatively, is calculated from additional parameters as the first actual operating parameter, and a delivery fluid viscosity or a parameter, in particular a fluid parameter with which the delivery fluid viscosity is in a physical relationship, in particular the delivery fluid temperature as the second operating parameter, whereby the aforementioned first actual operating parameter, i.e., the delivery fluid pressure and the additional actual operating parameter, preferably the delivery fluid viscosity or the delivery fluid temperature, are taken into account by means of the first limit value specifying means to calculate the first limit value, which when exceeded or when not met could result in a defect condition of the positive displacement pump. The comparator means then compare the manipulated variable output by the regulator, i.e., a rotational speed signal, with the first limit value, such that the first correction means output a corrected manipulated variable, i.e., a corrected rotational speed signal for the case when the manipulated variable output by the regulator goes beyond the parameter, which is in a functional relationship thereto, taking into account the delivery fluid pressure and the delivery fluid viscosity, such that the corrected manipulated variable, i.e., the corrected rotational speed signal, is preferably the first limit value calculated previously with the help of the first limit value specifying means. In this preferred embodiment, a delivery fluid volume flow (and/or the pump rotational speed, which reflects the delivery volume flow) or a delivery fluid pressure is used as the reference input variable.

This preferred embodiment is taken into account in the case, which often occurs in practice, namely when a rapid change in a disturbance variable, e.g., a sudden change in flow resistance, leads to a very rapid change in pressure and thus to a rapid change in the torque demand on the pump. In the case of a rapid drop in pressure with a large pump drive, this would lead to a rapid increase in the rotational speed. An unacceptable increase in rotational speed can be prevented by taking into account the delivery fluid pressure, preferably measured at the pressure connection, as the first operating parameter and directly or indirectly taking into account the delivery fluid viscosity as a second operating parameter in calculating the first limit value, so that damage to the pump can be prevented.

With small drive motors, a very rapid and sudden increase in pressure would lead to a rapid reduction in rotational speed so that here again taking into account the aforementioned initial operation parameters and the aforementioned additional operating parameters would lead to a corrected manipulated variable, i.e., a corrected rotational speed signal so that, again in this case, damage to the pump can also be prevented.

In the case of implementation of protection of the medium, the delivery fluid pressure, the delivery fluid volume flow and/or the rotational speed may be considered as the reference input variable or the delivery fluid viscosity and/or a parameter, in particular a fluid parameter, on which the delivery fluid viscosity depends directly is taken into account. The manipulated variable is preferably the rotational speed and/or a rotational speed signal, such that to calculate the limit value in particular, a maximum allowed rotational speed is preferably taken into account, preferably a delivery fluid volume flow as the first operating parameter, and the delivery fluid pressure is also taken into account as the additional actual operating parameter (measured in particular at the pressure connection of the pump).

As mentioned previously, the comparison with the at least one limit value may be performed in various ways. Thus it is especially preferred if the manipulated variable generated by the regulator is used for comparison with the first limit value, or as an alternative, the corrected manipulated variable output by the first correction means or the corrected manipulated variable output by additional correction means, for example, second correction means that are optionally present. It is also possible not to use the aforementioned manipulated variable directly or a corrected manipulated variable for the comparison, but instead to use a comparative value calculated on the basis of a predetermined functional relationship from the manipulated variable or a corrected manipulated variable. Similarly, it is also possible to use the manipulated variable generated by the regulator for the comparison with the second limit value or to use a corrected manipulated variable, in which case the corrected manipulated variable may be the corrected manipulated variable output by the first correction means, if said corrected manipulated variable is used, or it may be the corrected manipulated variable output by the second correction means. It is likewise possible to calculate a comparative value, e.g., a current shear rate based on one of the aforementioned values, and use it for the comparison.

As already indicated the logic means may compare the manipulated variable generated by the regulator, a corrected manipulated variable or a comparative value calculated on the basis of the manipulated variable and/or the corrected manipulated variable or to compare an actual operating parameter, in particular the first operating parameter and/or the additional actual operating parameter, with at least one specific fixed limit value for the positive displacement pump assigned to the control means, such that, for the case when the result is greater than or less than such a limit value by a certain amount, a corrected manipulated variable is output by correction means. If the actual operating parameter to be compared is a measured actual vibration value, for example, and if the latter exceeds a maximum amount for the specific positive displacement pump (limit value), then a corrected manipulated variable is output by the correction means, such that this manipulated variable correction may be placed before or after a possible correction by first correction means and/or by second correction means. In the simplest case, the corrected manipulated variable is a manipulated variable signal that has been increased or reduced by a certain factor or it is a manipulated variable signal that assumes a value stored in a memory or it may be a simulated calculated value which is not expected to be above or below the limit value.

The embodiment of the control means described last serves mainly to detect a sudden damage or a sign of sudden damage to the positive displacement pump. For example, if a vibration parameter is monitored by sensor means as a measured actual operating parameter, and if this value exceeds a limit value, which is stored in a nonvolatile memory or is preferably determined alternatively or additionally as a function of a measured actual parameter, then it is not the manipulated variable which corresponds to the reference input variable that is forwarded but instead a calculated manipulated variable which is reduced by a factor of 2, for example, in order to be able to operate the positive displacement pump as long as possible without any damage, for example, bearing damage, occurring or exacerbating, for which the increased vibration value might be an indicator.

There are various possibilities with regard to the specific embodiment of the regulator of the control means preferably formed by a microcontroller. The regulator is preferably embodied as a PI regulator or as a PID regulator.

There are different possibilities with regard to the choice and/or embodiment of the first actual operating parameter, which is sent to the regulator for ascertaining a manipulated variable, and on the basis of which the first (pump protection) limit value and/or the second (delivery fluid protection) limit value is optionally calculated, and which is optionally used for calculation of the corrected manipulated variable by the correction means. The first actual operating parameter is preferably an actual control variable, preferably measured, from the controlled system, in particular a so-called actual main control variable, for example, an actual pressure of the delivery fluid or an actual pressure difference of the delivery fluid, for example, between the suction side and the pressure side of the positive displacement pump, or it is an actual volume flow of the delivery fluid. The first operating parameter is preferably measured, but as an alternative, it may also be simulated or calculated, in particular from a plurality of additional actual operating parameters.

As already explained in the introduction, the first and/or second limit value(s) must be calculated not only on the basis of the first actual operating parameter supplied to the regulator but also on the basis of the functional relationship based on another additional actual operating parameter. The at least one additional actual operating parameter may be a measured auxiliary manipulated variable or one calculated on the basis of an actual value that is measured, for example, in particular of the frequency converter, for example, a rotational frequency setpoint value of the frequency converter or a torque setpoint value of the frequency converter. It is also possible that at least one additional actual operating parameter is a measured auxiliary control variable or one calculated on the basis of an actual value, in particular a rotational speed of the positive displacement pump motor or a torque of the positive displacement pump motor. It is possible that at least one additional actual operating parameter, which enters into the calculation of the first and/or second limit value and/or enters into the calculation of a corrected manipulated variable and/or into the calculation of a comparative value, may be a measured temperature, for example, a delivery fluid temperature or a storage temperature, in particular of a roller bearing of a drive spindle of the positive displacement pump. It is also possible that the at least one additional actual operating parameter is a measured vibration value. It is also possible that the at least one additional actual operating parameter is a measured or calculated delivery fluid viscosity. It is also possible that the at least one additional actual operating parameter is a measured leakage quantity. It is especially preferred if not only the first actual operating parameter is only a single additional actual operating parameter taken into account in the calculation of a limit value or a corrected manipulated variable but instead, for example, two or more additional actual operating parameters, preferably different parameters, are taken into account in addition to the first auxiliary operating parameter.

For applications of medium protection (preferably not for applications of pump protection) the at least one additional operating parameter may be a measured actual control variable, for example, a measured actual main control variable, for example, an actual pressure of the delivery fluid, an actual pressure difference or an actual volume flow.

If, for example, an actual pressure is measured as an operating parameter, for example, an excess pressure on the pressure connection of the positive displacement pump, then a pressure that is too high may endanger the positive displacement pump in particular possibly entailing the risk of rupture. The maximum allowed pressure may depend on additional actual operating parameters, such as the temperature of the delivery fluid, for example.

If the pressure at the suction connection is too low, it may be used as a cavitation indicator. The delivery fluid viscosity may be taken into account, preferably in addition to the pressure as an operating parameter, where the delivery fluid viscosity in particular is representative of the viscosity of the delivery fluid, especially its measured temperature for reasons pertaining to the measurement technology.

Thus the temperature may be monitored as an actual operating parameter in addition to or as an alternative to a pressure. Excess temperature of the delivery fluid may be a threat to the pump, in particular with regard to possible bearing damage.

The motor rotational speed may be taken into account as an actual operating parameter in the limit value calculation and/or in the calculation of a corrected manipulated variable, in addition or as an alternative to the pressure according to a fixed assignment and/or function which is directly proportional to the rotational speed of the positive displacement pump (spindle rotational speed), in particular corresponding to it. If the rotational speed is too high or too low, this may also constitute a risk, in particular when additional operating parameters, such as, for example, the temperature and/or the pressure, go beyond certain limits.

Vibration of the positive displacement pump and/or of the positive displacement pump motor may also be monitored in addition or as an alternative to the actual operating parameters mentioned above. Excessive vibration threatens the alignment between the positive displacement pump and the positive displacement pump motor, with the possible result being bearing damage to the positive displacement pump and/or to the positive displacement pump motor. Damage to bearing ring seals due to an unacceptable vibration is also possible. On the whole, the lifetime of positive displacement pumps can be reduced due to unacceptable vibration, in particular when additional actual operating parameters such as the rotational speed and/or the temperature and or the pressure exceeds certain limits or fail to meet other limits.

In addition or as an alternative to the additional operating parameters mentioned above, the viscosity of the delivery fluid which is functionally related to the temperature of the delivery fluid may also be taken into account directly or indirectly via the temperature in the determination of a limit value, a corrected manipulated variable or a comparative value, if any is provided. If the viscosity is too low, it may damage the positive displacement pump because of the resulting decline in lubrication properties of the delivery fluid between the spindles. If the viscosity is too high, that may also endanger the positive displacement pump so that the torque increases too much. Furthermore, it may also endanger the positive displacement pump for the viscosity to be too high (temperature too low), for example, when using a magnetic coupling which may break away without being noticed if the viscosity is too high, leading to the destruction of the positive displacement pump and/or the magnetic coupling.

In addition to the actual operating parameters mentioned above which are measured individually, in groups or preferably jointly to ensure protection of components (protection of positive displacement pump) or to ensure and/or guarantee the quality of the delivery fluid and then these parameters are taken into account in the calculations according to a mathematical function, at least one of the actual operating parameters described below may be monitored, for example, the torque which is functionally dependent on the viscosity of the delivery fluid. In particular the torque may be taken into account as an indicator of an increase in the positive displacement pump wear.

In addition or alternatively, the positive displacement pump motor current may also enter into the calculation of a limit value, a corrected manipulated variable or a comparative value, if any. The motor current is a variable, which is simple and inexpensive to measure, in particular when other parameters remain the same such as, for example, the viscosity for the torque which may in turn be an indication of wear on the pump. In addition or alternatively, the leakage rate may also be monitored. This is based on the idea that each bearing ring seal requires a nominal leakage, so that the static and dynamic components of the bearing ring seal are lubricated. If the leakage rate increases, this may be an indicator of incipient bearing ring seal damage.

If the manipulated variable generated by the regulator is not to be compared directly, although that is preferred, with a first or second limit value or if the same statement applies to the manipulated variable corrected by correction means, but instead a comparison value which is functionally related to the manipulated variable or the corrected manipulated variable, in addition or as an alternative for this comparison, then this comparative value may enter into the calculation on the basis of a functional relationship of several of the aforementioned actual operating parameters, in particular the first actual operating parameter and at least one of the additional actual operating parameters.

It is especially preferred if the first and/or second limit value specifying means and/or the first or second correction means take into account in their calculations such positive displacement pump-specific geometry parameters as the gap width and/or the spindle diameter when said geometry parameters are assigned to the control means. In addition or alternatively, the limit value specifying means and/or the correction means may be designed to take into account a delivery fluid parameter stored in a memory, in particular a shearing behavior of the delivery fluid.

Thus in particular with regard to the monitoring of the quality of the delivery fluid or the end product produced with it, it is advantageous to take into account the angular velocities of the positive displacement pump spindles in the calculation of a limit value, of a corrected manipulated variable or in the calculation of a comparative value, if any is provided. Preferably at least one geometry parameter as well as the angle of slope of the respective spindle should be taken into account here because different angles of slope of the spindle lead to different relative velocities within the positive displacement pump at the same motor rotational speed.

It is thus advantageous in particular with regard to monitoring the quality of the delivery fluid or of the end product produced with it to take into account the angular velocities of the positive displacement pump spindle in the calculation of a limit value, of a corrected manipulated variable or of a comparative value, if any is provided, in the calculation. Preferably at least one geometry parameter and the angle of slope of the respective spindle should be taken into account because different angles of slope of the spindle can lead to different relative velocities within the positive displacement pump at the same rotational speed of the motor.

A variant in which the at least one measured actual parameter, for example, the first actual operating parameter or an additional actual parameter is not supplied directly by the sensor means to the control means but instead at least one actual operating parameter is transmitted to the control means from a process control room, in particular over a bus system, as described in greater detail below.

It is especially preferred when a shear rate is taken into account in the calculation of the at least one first and/or at least one second limit value, in particular a maximum allowed shear rate stored in a memory and/or a shear rate calculated currently on the basis of at least one actual operating parameter is taken into account according to a functional relationship.

As already explained, it is conceivable that, in addition to a dynamic limit value consideration, there is also a static limit value consideration in which the manipulated variable, a corrected manipulated variable, a comparative value or directly a first operating parameter and/or another operating parameter is/are compared with a limit value stored in a memory, preferably not a volatile memory, of the logic means and, if the limit value should exceed a predetermined measure or fail to meet a predetermined standard, a corrected manipulated variable is determined and output so as not to threaten the pump or the product quality. In the simplest case, the manipulated variable provided for this purpose by the regulator or the manipulated variable already corrected on the basis of a previous comparison may be increased or decreased by a predefined amount, in particular a predefined factor.

In addition or as an alternative to at least one measured and first actual operating parameter and/or in addition or as an alternative to a measured or calculated additional actual operating parameter and/or at least one predefined positive displacement pump-specific geometry parameter, the first and/or second limit value specifying means and/or the first and/or second correction means may be designed to take into account a delivery fluid parameter (fluid-specific property value/constant) according to a mathematical function or allocation in the calculation of the corresponding limit value or of the corrected and manipulated variable, this value being stored in a nonvolatile memory of the control means, for example. It is preferably possible to select either manually or automatically among various fluid parameter data records, for example, as a function of a measurement result. The shear ratio of the delivery fluid is preferably taken into account as the delivery fluid parameter, in particular when a shear rate is used to determine a limit value or a corrected manipulated variable.

It is most especially expedient if the logic means is designed for determining and/or signaling a need for maintenance on the positive displacement pump as a function of a measured or calculated actual operating parameter and/or as a function of a positive displacement pump-specific parameter assigned to the control means. The logic means therefore preferably include a corresponding function unit which is designed to take into account the measured or calculated actual parameter and/or the positive displacement pump-specific parameters in determining the need for maintenance. This function unit preferably calculates the need for maintenance on the basis of a predetermined (functional) assignment. The need for maintenance is preferably signaled via corresponding signaling means, for example, a display and/or an LED lamp, which may emit signals of different colors.

It is especially expedient if the first and/or second correction means are designed so that, in the case when the limit value is exceeded by a predetermined value, in particular by a value that is very high or very low and/or if it fails to meet the set value, a stop signal is emitted for the positive displacement pump motor, in particular for a motor contactor, in particular to prevent further damage to the positive displacement pump or additional process systems or to the quality of the delivery fluid.

In a refinement of the present invention, it is advantageously provided that the control means are designed to communicate via a bus system, in particular a CAN bus system, in particular to be able to communicate with other positive displacement pump control means and/or a process control room, i.e., to be able to transmit and/or receive data. It is especially expedient if a CAN bus system, as is known primarily from automotive engineering, is assigned in the control module, in particular for communication with the control room and/or at least one additional module. It has surprisingly been found that such a bus system is especially reliable and sturdy in conjunction with positive displacement pump systems.

It is especially expedient if input means, in particular in the form of a key, preferably in the form of multiple keys and/or a touchscreen, etc., is/are assigned to the control means in order to be able to configure and/or read out the control means. One of many system parameter data records and/or delivery fluid parameter data records stored in a nonvolatile memory may be selected via the input means.

Most especially expedient is an embodiment of the control means in which the control means have memory means designed and controlled to store received, calculated and/or transmitted data, in particular measured values or voltage characteristics, in particular to also log them. The memory means are especially preferably designed and controlled to save measured actual operating parameters and/or reference input variables and/or manipulated variables and/or corrected manipulated variables.

The system preferably also comprises at least one sensor (sensor means), preferably at least two sensors which have a signal-conducting connection with the control means, such that the sensor(s) is/are designed and arranged for measuring the first actual operating signal and optionally at least one additional actual operating signal. For example, these may include a pressure sensor for determining a fluid pressure, in particular a differential pressure and/or a temperature, for example, a delivery fluid temperature or a storage temperature. This may also be a rotational speed meter for determining the rotational speed of the positive displacement pump and/or a torque meter for detecting the torque of the positive displacement pump motor and/or a vibration sensor for measuring a vibration value and/or a fluid viscosity meter for determining the fluid viscosity and/or a leakage rate meter and/or a volume flow meter. It is especially expedient if the control means have a signal-conducting connection to the frequency converter in order to receive an actual auxiliary manipulated variable as the first and/or at least one additional actual operating parameter, in particular a rotational frequency setpoint value or a torque setpoint value from the frequency converter.

In a refinement of the invention, it is advantageously provided that the logic unit of the control module is designed for detecting and/or signaling the need for maintenance of the pump module, namely as a function of the analysis of an actual operating parameter, which can optionally be checked by the logic unit with regard to maintenance relevance, in particular taking into account a database. It is especially expedient if the logic unit is designed and/or programmed so that the need for maintenance is detected a sufficient amount of time before the actual procedure is required in order to be able to ascertain a period of time until the recommended maintenance procedure is to be performed. As will be explained in greater detail below, the need for maintenance and/or the recommended period of time until the maintenance is/are henceforth the responsibility of a so-called master box of the control modules in the event that multiple control modules are provided. Communication with this master box may take place over a bus system, for example, in particular a CAN bus system.

As already indicated above, it is especially expedient if a bus system is assigned to the control module for communication with a control room and/or with another control module and/or with a sensor module and/or it is expedient for the control module to be connected to such a bus system. A CAN bus system which is known from automotive engineering has surprisingly proved to be especially advantageous, reliable and robust in conjunction with a pump system. The sensor module which is preferably used may as an alternative also communicate with the control module and/or a control room via a digital connection and/or an analog connection.

It is especially expedient if multiple control modules are connected to the aforementioned bus system such that a positive displacement pump module is preferably assigned to each control module and subsequently also a drive module is assigned to it.

As already indicated previously, it is preferable if one of several control modules being used is designed as a so-called master box, i.e., having an increased functionality. This is understood to mean that this control module is designed for receiving and storing data, which it receives from other control modules in the system, for example, status information and/or actual system parameters (actual operating parameters) and/or rotational speed setpoint signals and/or system setpoint parameters. Such a master box is preferably additionally or alternatively equipped with signaling means, for example, a display screen, a light fixture, in particular one using LEDs, and/or a loudspeaker to be able to communicate with a user and/or to be able to signal an event to the user, for example, a disturbance and/or the need for maintenance, optionally including a proposed maintenance period until the maintenance is actually due.

With regard to the design of the at least one sensor module, there are various possibilities. It may be designed, for example, as a vibration sensor, in particular for detecting critical vibrations of a pump module or with a pressure sensor for detecting an actual pressure and/or as a temperature sensor for detecting an actual temperature and/or as a flow rate sensor for detecting an actual flow rate and/or as a torque sensor for detecting a torque of the pump module. It is conceivable to combine several such sensors in one sensor module or to provide separate sensor modules for different sensors. The sensor module signal may be routed directly to the control module, for example, or via the control room, if one is used.

It is especially expedient if a database having system-specific information, in particular pump module-specific information is provided in the control module so that the logic unit of the control module can access said information to thereby be able to stipulate a suitable setpoint rotational speed and/or a suitable setpoint system parameter for the regulator of the control module.

The present invention also relates to the use of a control module comprising a logic unit and a regulator in particular a PI or PID regulator for generating a manipulated variable, in particular a setpoint rotational speed signal for a drive unit as a function of at least one actual system parameter and as a function of a reference input variable such that the reference input variable is preferably preselectable by a control room.

BRIEF DESCRIPTION OF THE DRAWINGS

Additional advantages and details of the invention are derived from the following description of preferred exemplary embodiments and on the basis of the drawings, which show.

DETAILED DESCRIPTION

Figure 1:
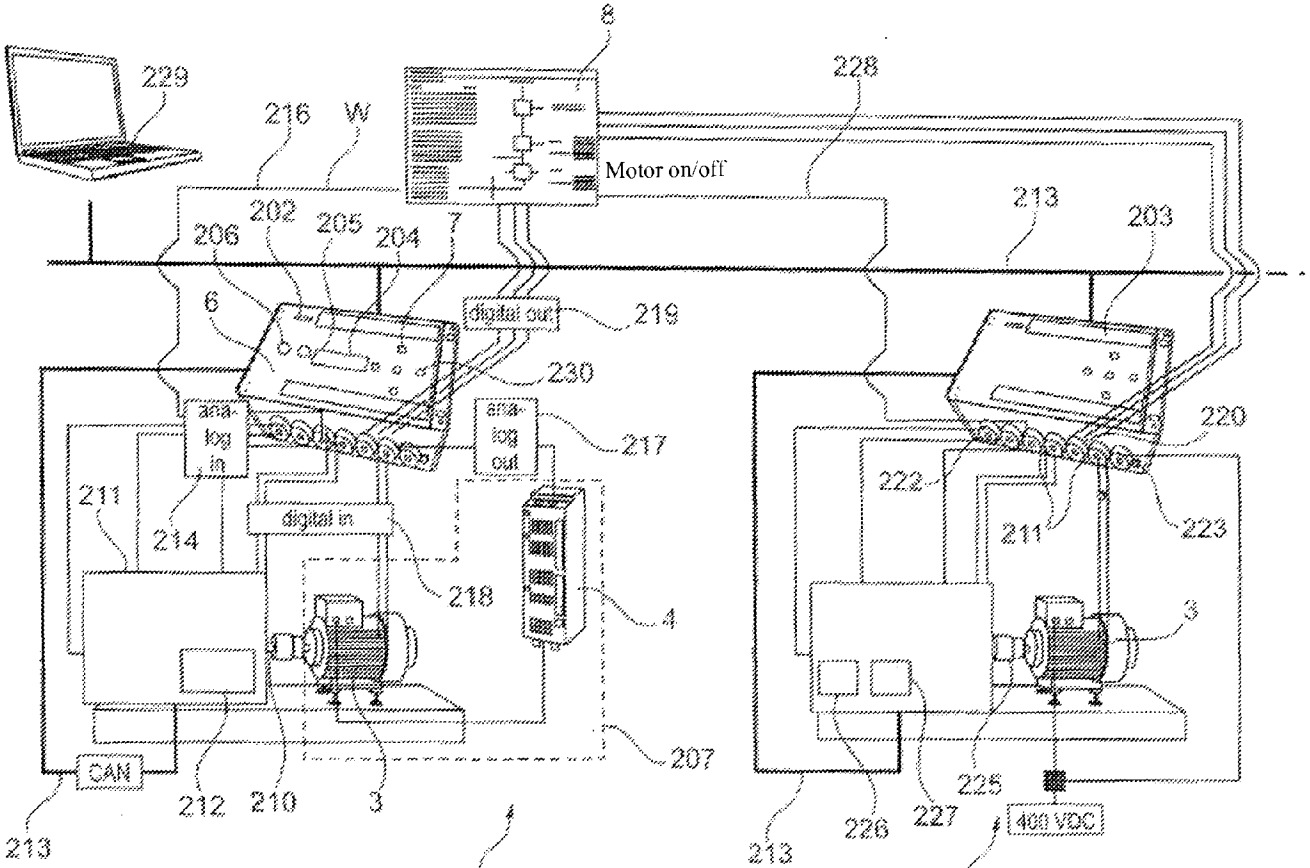
FIG. 1 a possible design of a pump system having two control modules, each of which is assigned a drive module and a pump module, such that the two control modules have an optional higher level control room, FIGS. 2 to 5 different result scenarios on the example of the pump system according to FIG. 1, and FIG. 6 a possible embodiment of control means in the form of control modules designed to compare a manipulated variable generated by a regulator with a first (pump protection) limit value, in particular for a system according to FIGS. 1 to 5, FIG. 7 an alternative embodiment of control means, which are in the form of control module(s) designed to compare a manipulated variable generated by the regulator with a (delivery fluid protection) limit value, in particular for a system according to FIGS. 1 to 5, FIG. 8 another embodiment variant of control means in the form of control modules for a positive displacement pump system, such as that shown as an example in FIGS. 1 to 5, such that the manipulated variable generated by the regulator can be compared and optionally corrected with a first limit value and/or a second limit value and such that the sequence of comparisons may also be different than that illustrated in FIG. 8, i.e., may be implemented in the opposite order, FIG. 9 a NPSH diagram and FIG. 10 the physical relationship in a diagram between the delivery fluid pressure, measured at the pressure connection of the pump, the delivery fluid viscosity (medium viscosity) and the pump rotational speed, namely here a minimum rotational speed of the pump.

The present embodiments will now be described more fully hereinafter with reference to the accompanying drawings, in which some embodiments are shown. The subject matter of the present disclosure, however, may be embodied in many different forms and should not be construed as limited to the embodiments set forth herein. Rather, these embodiments are provided so that this disclosure will be thorough and complete, and will fully convey the scope of the subject matter to those skilled in the art. In the drawings, like numbers refer to like elements throughout.

The positive displacement pump system 1 shown in the figures comprises a first and a second control module 202, 203, the control module of which (first control module 202) shown at the left of the drawing is equipped as a so-called master box having signaling means 204, namely in the form of a display screen 205 and an LED lamp.

In addition to the signaling means 204, the first control module 202 (master box) is designed as a data memory unit (data logger), in contrast with the second control module 203, this data memory unit being connected to the second control module 203 in a signal-conducting manner and data transmitted by same, for example, the actual operating parameters, reference input variables or predefined rotational speeds are saved and are preferably provided with a time code. The signaling means 204 serve to signal control units or to display the need for maintenance and proposed times for performing the maintenance detected by the first control module 202 and/or the second control module 203 or optionally additional control modules (not shown).

A drive module 207 comprising an electric drive motor 3 designed here as an asynchronous motor; a frequency converter 4, which is assigned to the former and is shown separately here merely for the purpose of better illustration, preferably being arranged directly on the drive motor 3, is provided for the first control module 202.

The drive module 207, or more specifically the drive motor 3 of the drive module 207, is operatively connected by a coupling 210 to a first pump module 211 designed as a helical spindle pump.

A sensor module 212 for detecting an actual operating parameter X is arranged on the first pump module 211. In the exemplary embodiment shown here the sensor module is equipped with a vibration sensor to be able to detected unacceptable vibrations, which are then analyzed by the first control module 202, more specifically by integral logic means 7, in particular by comparison with information stored in an integral database of the control 202.

As shown in FIG. 1, the first sensor module 212 has a signal-conducting connection to the first control module 202 via a bus system 213, which is a CAN bus system here.

Logic means 7, which are mentioned above but are not shown here, are integrated into the first control module 202, and a regulator 6, which is also not shown for reasons of simplicity, but is designed as a PID regulator in the exemplary embodiment shown here, for generating a manipulated variable, which is to be described in greater detail below, or a corrected manipulated variable for the first frequency converter 4, which is not designed or alternatively is not used and/or controlled and/or supplied with actual system parameters to generate a setpoint rotational speed signal itself as a function of a pressure signal and/or a flow rate signal and/or a vibration sensor signal and/or a temperature sensor signal and/or a torque signal.

The first control module 202 like the second control module 203 has a plurality of inputs and outputs which are emphasized in the diagram for better visualization. The first control module 202 comprises analog inputs 214 by which the first control module 202 has a signal-conducting connection to a higher level control room (reference input variable specifying means 8). A reference input variable W or alternatively a manipulated variable can be transmitted from the control room over a connection which is designed here as an analog connection 216, such that the manipulated variable, for example, is looped through the first control module 202 and is sent to the first frequency converter 4 via one of preferably several analog outputs 217. As will be explained in greater detail below, however, the first control module 202 is also capable of independently generating a manipulated variable, in particular a rotational speed setpoint signal as a function of a reference input variable W, an actual operating parameter X and at least one additional operating parameter with which the first frequency converter is controlled.

In addition to the analog inputs 214, there is a plurality of digital inputs 218.

In addition, there is also a plurality of digital outputs 219 over which the data signals and other data can be transmitted to the control room.

It can be seen that the first control module 202 not only communicates with the sensor module 212 and/or receives data from it over the bus system 213 but also is connected to the second control module 203 via the bus system 213 which is designed as a CAN bus system. This second control module like the first control module 202 comprises (second) digital output 220, (second) digital inputs 221, (second) analog inputs 222 and (second) analog outputs 223 for transmitting a manipulated variable generated by the second control module 203 as a function of a reference input variable preselected by the control room or a manipulated variable preselected by the control room to the frequency converter (not shown separately) of a second drive module 224, which is operatively connected via a second coupling 225 to a second pump module 226, also designed as a positive displacement pump to which a second sensor module 227 is also assigned and by which the bus system 213 communicates with the second control module 203.

The control room (example of reference input variable specifying means 8) can transmit a motor-on signal and a motor-off signal via a digital connection 228 to the second control module 203, so that the second control module 203 controls the drive module 224 on the basis of this signal.

Instead of the sensor modules 212, 227, which are designed as vibration sensor modules and are shown here, additional sensors and/or sensor modules may additional or alternatively each be provided with one or more sensors to detect a wide variety of actual system parameters in the area of the respective pump module 211, 226.

A computer 229 which preferably communicates with the control modules 202, 203 via the bus system 213 may be provided for output and/or programming.

As shown in FIG. 1, the first control module 202 also comprises, in addition to the signaling means 204, input means 230 for performing input, preferably via menu control. The second control module 203 is not designed as a data memory unit for storing data received from other control modules, in contrast with the first control module 202, but instead in the exemplary embodiment shown here the second control module is only a second LED light and is not a display, so that one embodiment may also be implemented completely without signaling means.

Different scenarios that may occur during operation of the pump system 1 are described below with reference to FIGS. 2 through 5.

Figure 2:
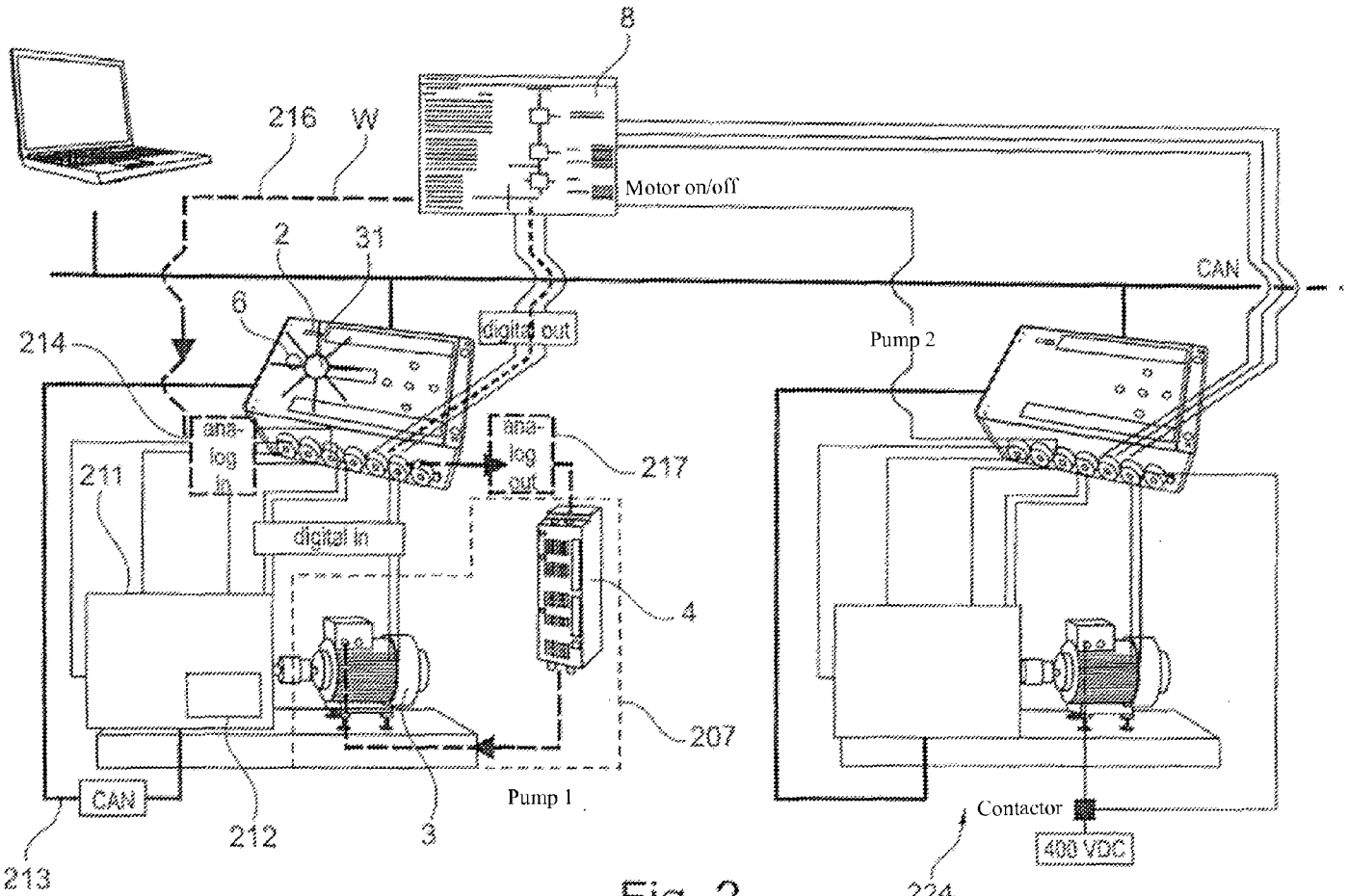

In the scenario shown in FIG. 2, the drive motor 3 of the first pump module 211 runs at a rotational speed generated by the frequency converter on the basis of a rotational speed output by the first control module 202. The corresponding and/or fundamental reference input variable W is fed via the analog connection 216 into one of the analog inputs 214 of the first control module 202, which determines a manipulated variable that is output via a analog output 217 and is sent to the first frequency converter 4 which controls the first drive motor 3 in accordance with the manipulated variable, doing so on the basis of the reference input variable W as well as taking into account an actual operating parameter. All the monitored actual system parameters, in particular a vibration signal determined by the first sensor module 212, which is sent to the first control module 202 via the bus system 213, are below the warning levels stored in a database of the logic unit of the first control module 202. A green LED 231 of the LED lamp 206 lights up.

Figure 3:
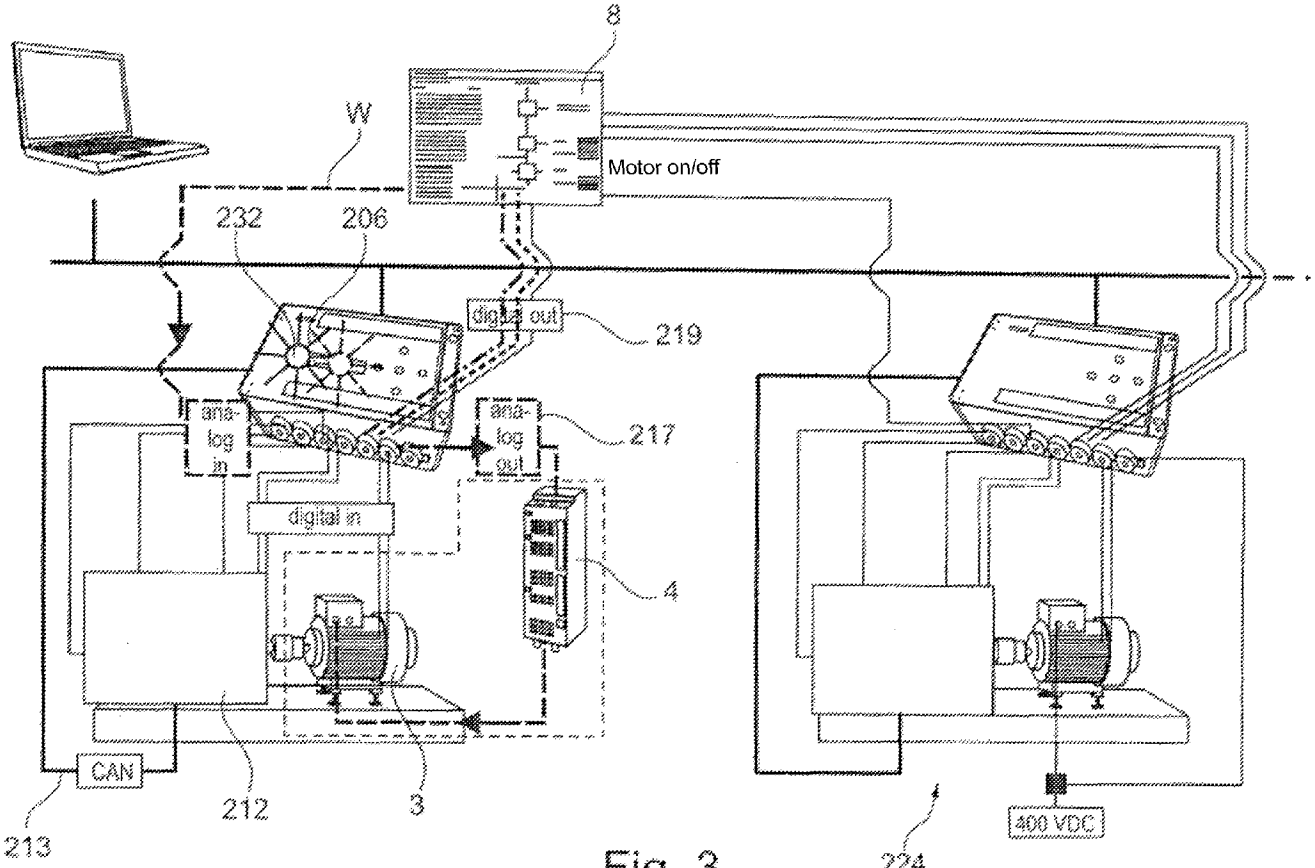

In a second scenario which is illustrated in FIG. 3, an actual operating parameter, namely the total vibration of the first pump module 211 determined by the first sensor module 212, reaches a first warning threshold stored in the aforementioned database of the logic unit of the first control module 202, with the result that the first logic unit controls the first signaling means 204 in such a way that a yellow LED 232 of the first LED lamp 206 lights up. Furthermore, a corresponding warning and/or information is/are displayed on the display screen 205 as the signaling means 204. In the software of the logic unit of the first control module 2 it is stipulated that on reaching the first warning threshold, the first pump module 211 is to be operated at a slower rotational speed in order to maintain the allowed maximum vibration levels. The logic unit of the first control module 202 subsequently determines a manipulated variable that has been corrected downward and then is sent over the analog output 217 to the first frequency converter 4 of the first drive module 207. In addition, corresponding information is also output to the control room over one of the digital outputs 219. Depending on the programming, it can also be stipulated that the control room will decide whether the setpoint rotational speed specification set by the control room and determined by the actual process or the setpoint rotational speed specification of the second control module 203 will be routed to the frequency converter.

Figure 4:
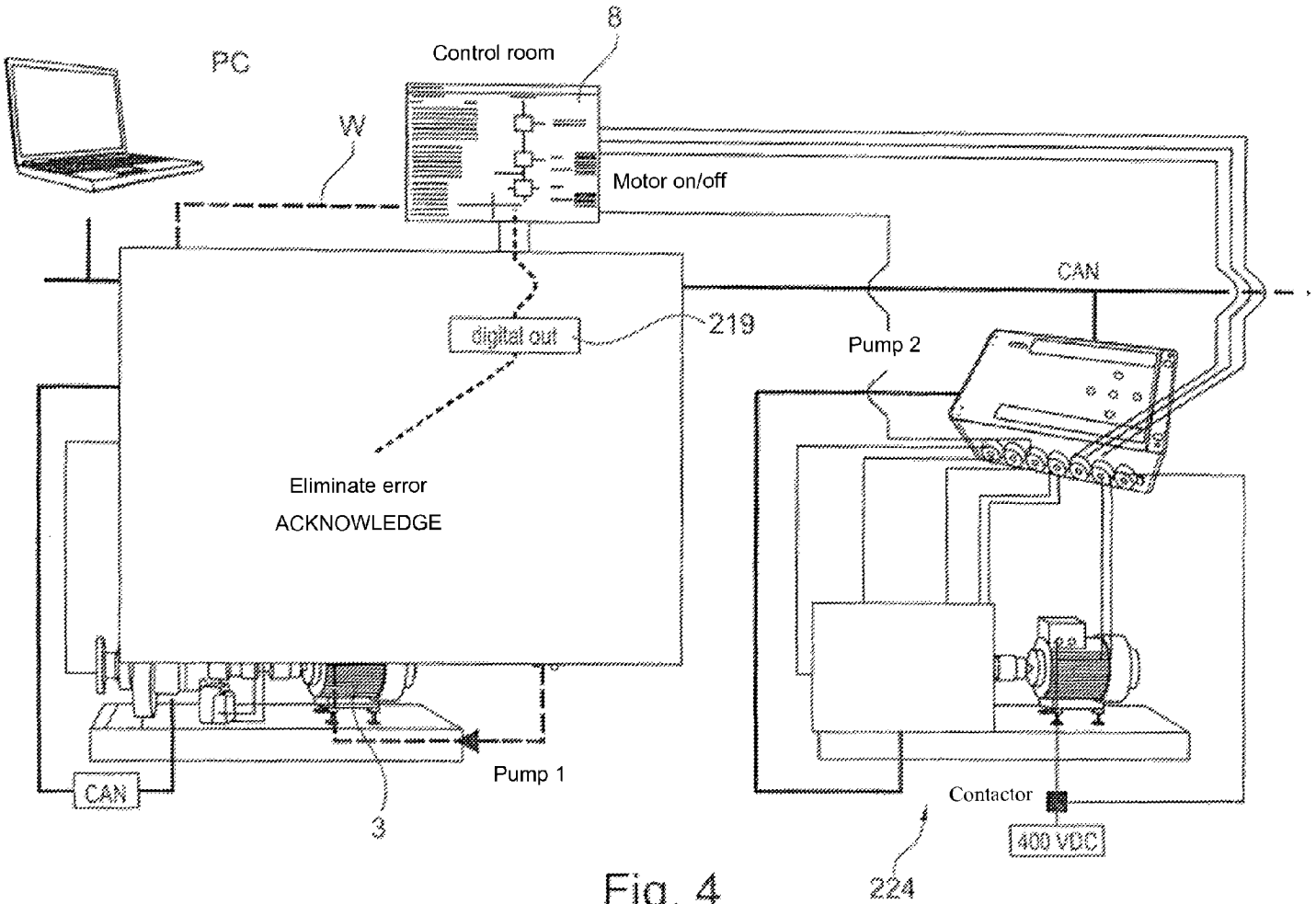

The scenario depicted in FIG. 4 is a result of the scenario described above with reference to FIG. 3. The reason for the increased vibration values has been eliminated. The fault elimination was acknowledged in the first control module 202, so the logic unit causes the green LED 231 on the first control module 202 to light up. It is stipulated in the logic unit of the second control module 203 in conjunction with the integrated PID regulator of the second control module 203 that now the first pump module 202, or more specifically its upstream drive motor 3 can continue operating with the setpoint rotational speed preselected by the control room. Furthermore, the fact that the fault has been eliminated is reported by the logic unit to the control room via one of the digital outputs 219 and the correspondence of the setpoint rotational speed signal preselected by the control room is eliminated.

Figure 5:
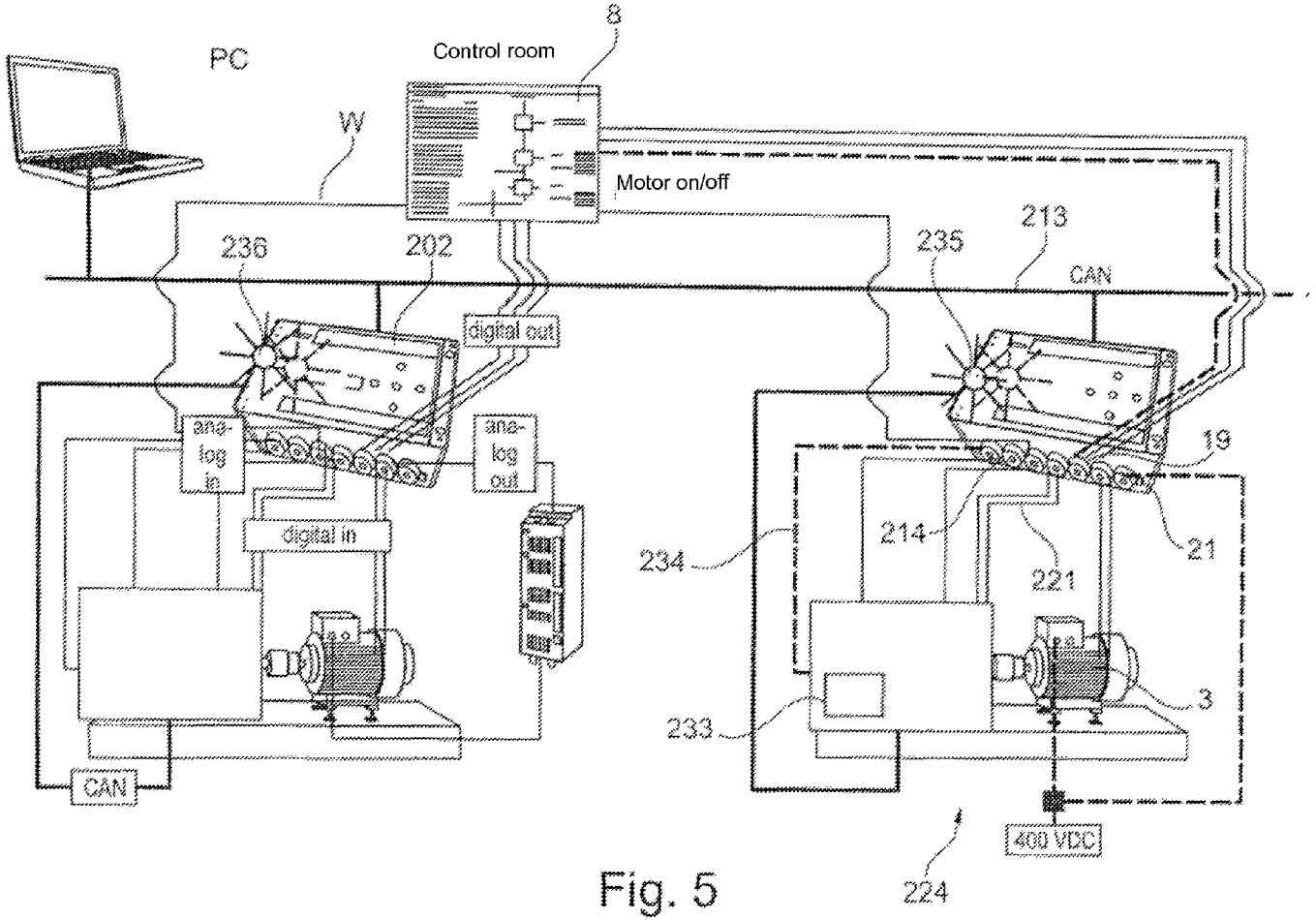

With the scenario depicted in FIG. 5, a sudden rise in pressure on the pressure side is detected and/or measured via a pressure sensor module 233 and is transmitted over an analog connection 234 to one of the analog inputs 214 of the second control module 203. The logic unit of the second control module 203 detects by database comparison that an allowed limit value has been exceeded (warning threshold) and causes a red LED 235 on the second control module 203 to flash. In addition, a corresponding item of information is transmitted over the bus system 213 to the first control module 202, where the integral logic unit ensures that the control case is signaled via a red LED 236. In addition, a corresponding message is sent to the control room from the logic unit of the second control module 203 over a digital output 19. It is stipulated in the logic unit inside the second control module 203 that in the present case the drive motor 3 is shut down so that the second pump module will not be damaged. The motor protection is triggered accordingly via a digital output 221, which results in the drive motor 208 being shut down.

Figure 6:
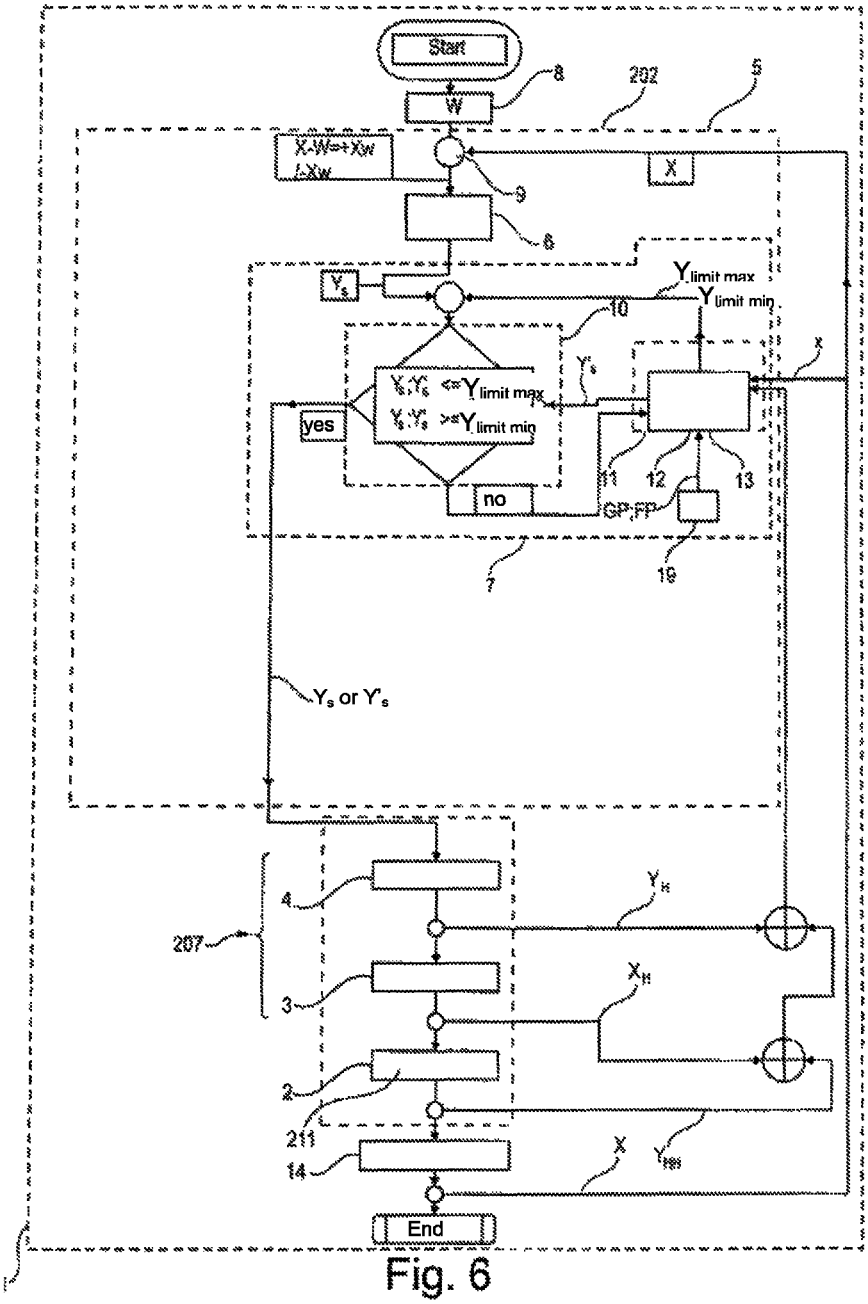
Figure 7:
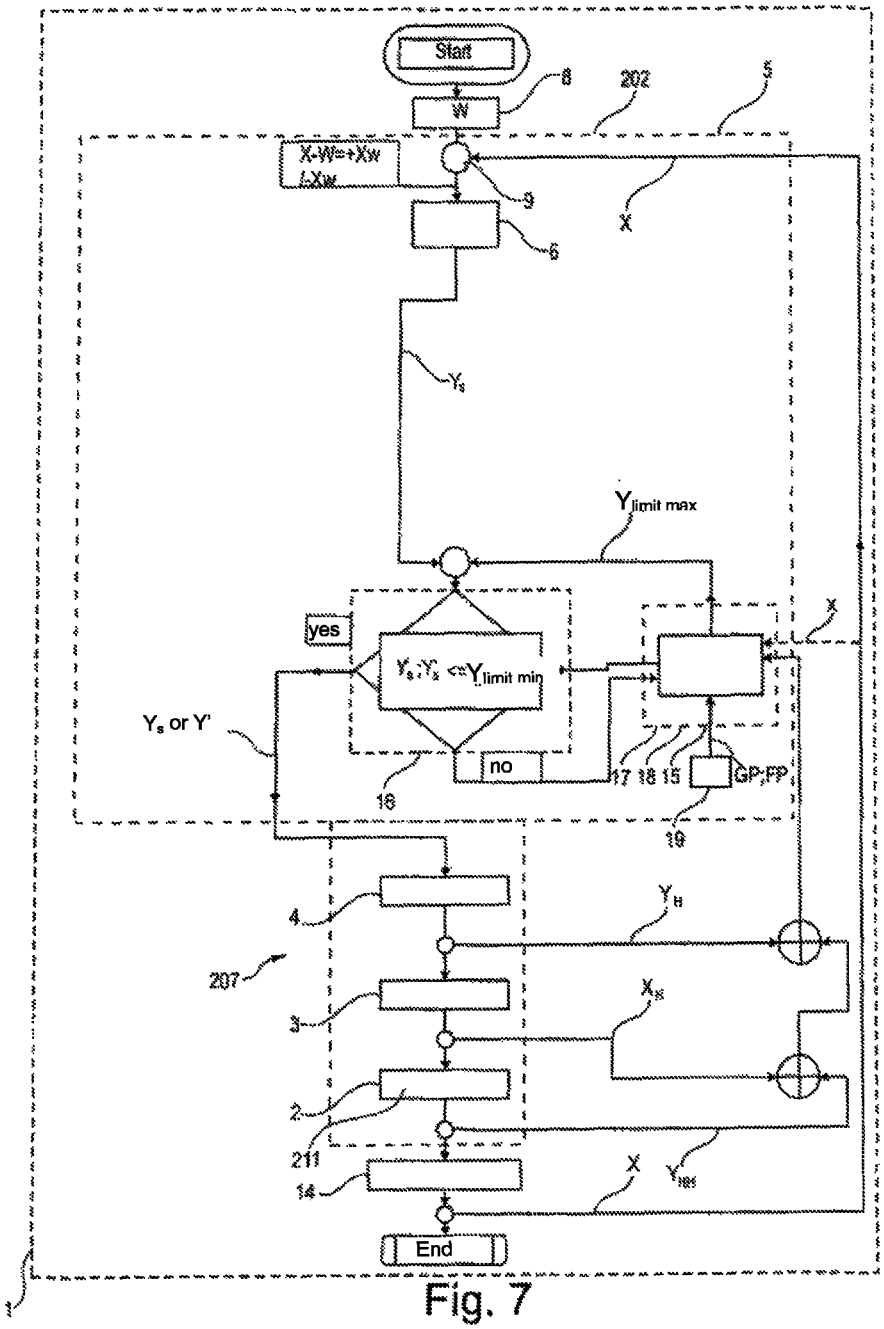
Figure 8:
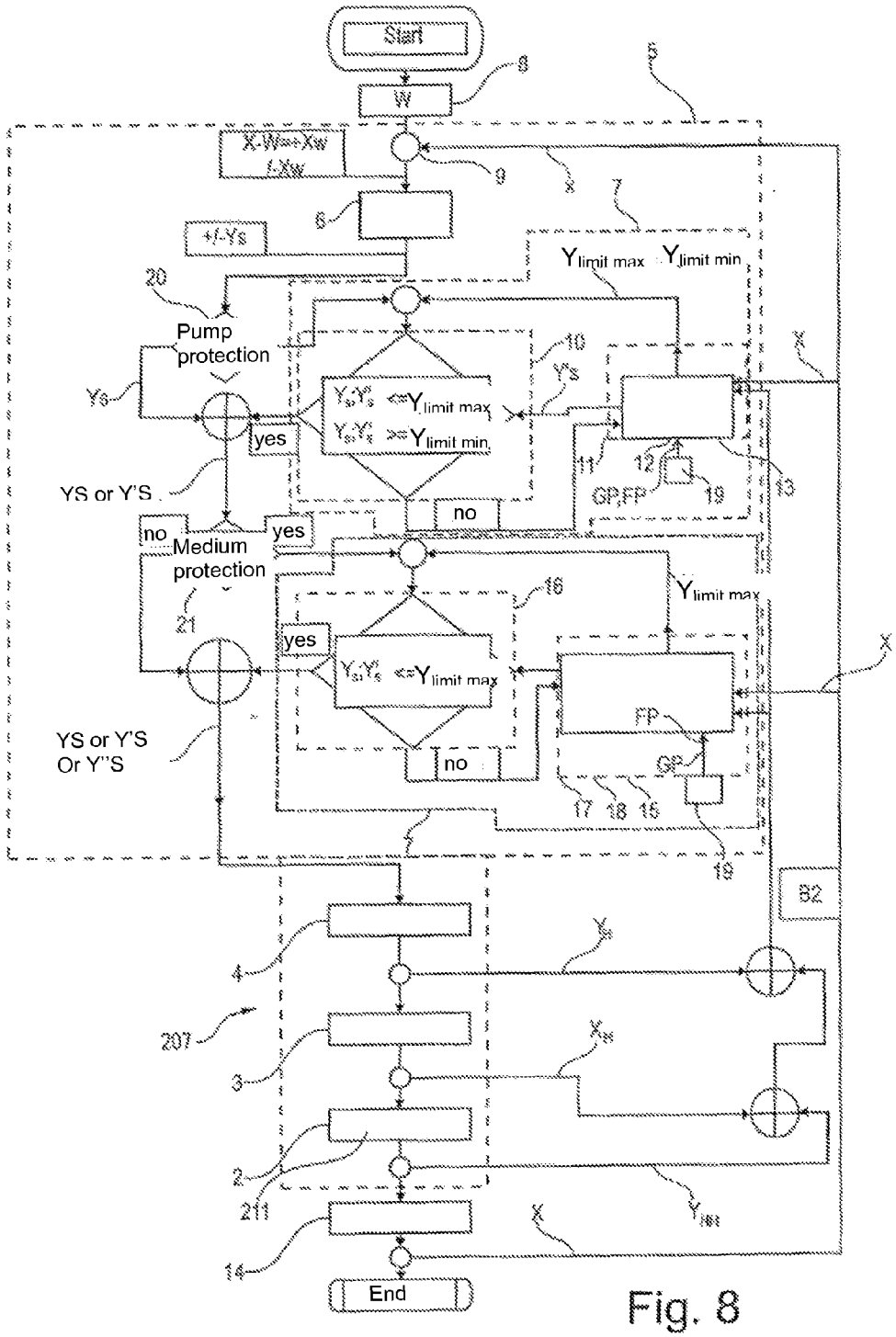
Figure 9:
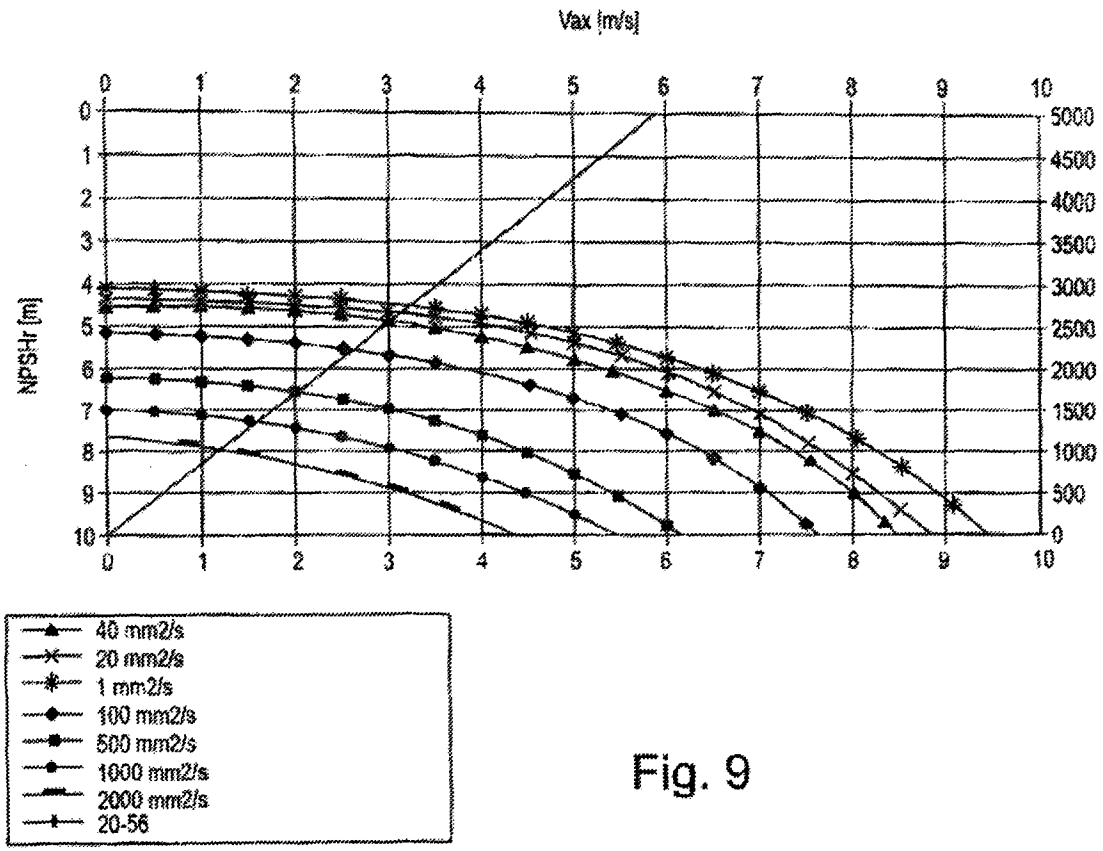

Then with references to FIGS. 6 to 8 different exemplary embodiments of positive displacement pump systems are described, each of which has a control module which is designed as a separate unit and is spaced a distance away from the drive module and is accommodated in a separate housing. On the basis of the exemplary embodiments, the functioning of the control means, which are in the form of the control module, is described in detail. This functioning of the control module shown can also be implemented by the control modules shown in FIGS. 1 through 5.

The functions described with reference to FIGS. 1 through 5 in conjunction with the control modules shown there may additionally or alternatively also be implemented in the control module shown in FIGS. 6 through 9.

Exemplary Embodiment According to FIG. 6

FIG. 6 shows schematically the design of a positive displacement pump system 1, comprising a positive displacement pump 2, which is designed in the embodiment shown here as a single-spindle pump or a multi-spindle pump, in particular a triple-spindle pump. The positive displacement pump 2 is operatively connected to a motor shaft of a positive displacement pump motor 3, which is designed as an electric motor comprising a frequency converter 4 which controls and/or regulates the flow of electricity to the motor windings of the displacement motor pump 3 as a function of a manipulated variable $Y_S$ generated by the regulator 6 or a corrected manipulated variable $Y'_S$ or a manipulated variable $Y'_S$ which has optionally been corrected multiple times. The positive displacement pump motor and the frequency converter form a drive module 207.

To generate the manipulated variable $Y_S$ or a corrected manipulated variable $Y'_S$, the positive displacement pump system 1 comprises control means 5 formed by a microcontroller, for example, including a regulator 6 as mentioned above as well a logic means 7. The control means 5 are in the form of a control module 202, which is separate from the drive module 207 and has its own housing.

Reference input variable specifying means 8, for example, a process-controlled panel supplying reference input variables W to the control means 5 are provided upstream from the control means 5 and are preferably separate from the latter, where the reference input variable supplied is an electric voltage signal representing a setpoint volume flow or a setpoint pressure, for example.

The reference input variable W and a first actual operating parameter X supplied from the outside are sent to the regulator 6, more specifically to a difference forming unit 9 of the regulator 6 which calculates the difference X−W. The actual regulator 6, which is embodied as PI regulator or a PID regulator, for example, thus determines a manipulated variable $Y_S$, on the basis of the reference input variable W and the first actual operating parameter X, which is measured here; this manipulated variable $Y_S$, is not sent directly to the frequency converter 4, as in the state of the art, but instead first passes through the logic means 7, comprising first comparator means 10 in the exemplary embodiment shown here. The comparator means compare the manipulated variable $Y_S$ generated by the regulator 6 with at least one first limit value, preferably a maximum first limit value $Y_{limit\ max}$ to be maintained and/or a minimum limit value $Y_{limit\ min}$ to be maintained. Instead of the direct comparison of the manipulated variable $Y_S$ with the at least one first limit value, a comparative value that is functionally related to the manipulated variable $Y_S$ may be calculated with the help of (optional) comparative value specifying means (not shown here) on the basis of the manipulated variable $Y_S$, such that at least one actual operating parameter, for example, the first actual operating parameter X, and at least one additional actual operating parameter to be explained in greater detail below, may also enter into the calculation of same according to a functional relationship. The comparative value specifying means may also take into account a geometry parameter of the positive displacement pump and/or a delivery fluid parameter according to a functional relationship for calculation of the comparative value, said parameter(s) then also having to be taken into account further in taking into account the limit value. In the exemplary embodiment shown here, this additional comparative value calculation step is eliminated, however, and the manipulated variable $Y_S$ is compared directly with at least one first limit value $Y_{limit\ max}$ and/or $Y_{limit\ min}$, such that the at least one first limit value is a positive displacement pump protection limit value which when exceeded or not met will or could result in a defect in the positive displacement pump.

A first function unit 11 is assigned to the comparator means 10, including an addition to first limit value specifying means 12, first correction means 13. The function unit 11 calculates the at least one first limit value $Y_{limit\ max}$, $Y_{limit\ min}$, which is sent to the comparator means 10 in addition to the manipulated variable $Y_S$ generated by the regulator 6. The comparator means then check on whether the manipulated variable $Y_S$ drops below a maximum first limit value $Y_{limit\ max}$ and/or whether the manipulated variable $Y_S$ exceeds a minimum first limit value $Y_{limit\ min}$. If this is the case, then the manipulated variable $Y_S$ is an admissible manipulated variable, which does not pose a threat for the positive displacement pump and can be supplied for additional comparisons and correction routines that are not shown here or may be sent directly, as shown here, as an input signal to the frequency converter 4 which then triggers the positive displacement pump motor 3 on this basis.

To calculate the at least one first limit value, the first actual operating parameter X is sent to the first function unit 11, and another measured or calculated actual operating parameter $Y_H$ and/or $X_H$ is also sent to the function unit, such that the actual operating parameter $Y_H$ in the exemplary embodiment shown here is an auxiliary manipulated variable of the frequency converter, for example, a rotational frequency setpoint value or a torque setpoint value of the frequency converter. These are not measured values but instead are values that are calculated, in particular being simulated, on the basis of at least one actual parameter, for example, on the basis of a current control measurement by the frequency converter. The additional actual operating parameter $X_H$ in the exemplary embodiment shown here is an auxiliary control variable, for example, a motor rotational speed and/or a displaced pump rotational speed or a torque which is preferably measured directly on the motor 3. Thus in each case an operating parameter, for example, the first actual operating parameter, namely here the actual value of the control variable from the process control system 14, is taken into account by the first limit value specifying means 12 for calculating the at least one pump protection limit value, and at least one additional actual operating parameter $Y_H$, $X_H$ or one main manipulated variable $Y_{HH}$, preferably a measured variable for the process control variable X, for example, a pressure or a volume flow is also taken into account.

For the case when the comparator means finds that the maximum first limit value $Y_{limit\ max}$ has been exceeded and/or the minimum first limit value $Y_{limit\ min}$ has not been met, this is reported to the first function unit 11 whose first correction means 13 then calculate a corrected manipulated variable $Y'_S$ taking into account the first actual operating parameter X and one of the aforementioned additional actual operating parameters $Y_H$, $X_H$, $Y_{HH}$. This corrected manipulated variable $Y'_S$ may then be sent as shown here to the comparator means as an input variable for comparison with a first limit value $Y_{limit\ max}$ and/or $Y_{limit\ min}$ or sent to another comparison and correction procedure bypassing the comparator means (not shown) or sent directly as an input signal to the frequency converter 4.

From a memory 19, preferably nonvolatile, specific geometry parameters GP for the positive displacement pump assigned to the control means 5 and/or specific delivery fluid parameters FP for the delivery fluid such as, for example, the shear behavior of the delivery fluid may be sent to the first limit value specifying means 12 and/or to the first correction means 13 so that they enter into the calculation of the first limit values $Y_{limit\ max}$, $Y_{limit\ min}$ and/or the corrected manipulated variable $Y'_S$ within the context of a functional relationship.

In the exemplary embodiment presented here, the corrected manipulated variable $Y'_S$ is the maximum or minimum allowed first limit value $Y_{limit\ max}$, $Y_{limit\ min}$, to approximate the manipulated variable $Y_S$ generated by the regulator as closely as possible. To this extent the first limit value specifying means 12 and the first correction means 13 include a common computer (computer means), because the corrected manipulated variable $Y'_S$ in the exemplary embodiment presented here corresponds to a first limit value $Y_{limit\ max}$, $Y_{limit\ min}$. The manipulated variable $Y_S$ generated by the regulator is overwritten by the corrected manipulated variable $Y'_S$.

In particular when the corrected manipulated variable $Y'_S$ should not correspond to the first limit value, the first correction means 13 and the first limit value specifying means 12 may be implemented as completely separate units, i.e., with their own computation means, i.e., in separate function units. This is of course also possible for the case presented above, namely wherein the corrected manipulated variable $Y'_S$ should correspond to a first limit value, so that in this case as shown in FIG. 1, the limit value specifying means 12 and the correction means 13 are fused together, i.e., they have a shared computation routine.

The exemplary embodiment according to FIG. 1 is described in greater detail below on the basis of exemplary variants of concrete embodiments that are not restricted.

First Example

The first actual operating parameter X corresponds to the actual control variable namely in the exemplary embodiment shown here, a pressure measured in bar. It is assumed that the reference input variable X is a pressure and amounts to at least 20 bar. Likewise the actual operating parameter X is measured as 20 bar.

Then there is a change in the reference input variable. The reference input variable X changes, for example, from 20 bar to 10 bar due to a corresponding stipulation. This results in a controlled deviation of W−X=10 bar.

The regulator 6 determines a new manipulated variable $Y_S$, namely in this case a voltage value, which is proportional to the rotational speed and is much smaller than that in a previous run and/or in a previous calculation. The first limit value specifying means 12 calculate a minimum allowed limit value $Y_{limit\ min}$ which represents a minimum allowed rotational speed in the exemplary embodiment presented here. It is desirable to maintain a minimum allowed rotational speed in order to avoid the risk of a lubricant failure if the rotational speed drops below this minimum allowed rotational speed.

The minimum allowed rotational speed, i.e., the minimum allowed limit value $Y_{limit\ min}$ is calculated on the basis of the following functional relationship:

$$Y_{limit\ min} = n_{allowed} = \left(\frac{p}{k \cdot b \cdot c \cdot \nu^{\alpha}}\right)^2$$

In this functional relationship, $Y_{limit\ max}$ corresponds to the minimum allowed limit value. This is a minimum allowed rotational speed ($n_{allowed}$).

The first actual operating parameter X in this case is the measured control variable, namely here the new actual pressure of 10 bar. The factor $\cdot^{\alpha}$ is another operating parameter, namely a measure of the operating viscosity of the delivery fluid, which is determined by a temperature measurement of the delivery fluid, and/or for the influence of the viscosity on the maximum allowed pressure. In the exemplary embodiment shown here, this value amounts to $10^{0.32}$ for the specific medium in question. The constant k is the correction value for the lubricating ability of the medium, which amounts to 0.75, for example, for the specific medium.

The constant b is a correction value for the tribological load-bearing capacity of the pump housing. In the exemplary embodiment shown here, this amounts to 1. The pump-specific characteristic value c is a characteristic value for the rotor diameter under an ideal load. In the exemplary embodiment shown here, this amounts to 0.55, for example.

The minimum allowed limit value $Y_{limit\ min}$ is sent to the first comparator means 10 which compares the manipulated variable $Y_S$ determined by the regulator 6 with the minimal allowed limit value. Depending on the result of the comparison, either the manipulated variable $Y_S$ determined by the regulator is transmitted to the frequency converter or a corrected manipulated variable $Y'_S$ is calculated by the first correction means, preferably corresponding to the minimum allowed limit value $Y_{limit\ min}$ calculated previously (or calculated anew).

Second Example

The first actual operating parameter X corresponds to the actual control variable, namely here a pressure. An actual pressure of 20 bar is measured. Based on a corresponding stipulation, the setpoint value of the control variable changes, i.e., the reference input variable W changes from 20 bar to 30 bar. At the same time there is a change in the disturbance variable. It is assumed that the flow resistance increases as a result of a smaller flow-through area, i.e., a smaller flow-through diameter, for example, due to a change in tool.

In practice this results in the actual operating variable X, i.e., the actual pressure definitely exceeding the reference input variable W or it would exceed it because the pump is still operating at an unchanged rotational speed but in the mean time the flow resistance has increased significantly due to the tool replacement.

The resulting control deviation at the difference forming output then leads to a significant decline, i.e., reduction in the manipulated variable $Y_S$. For the case when this is transmitted uncorrected to the frequency converter 4 as a setpoint stipulation, this would result in a risk to the pump with regard to the admissible pressure at a reduced low rotational speed. To prevent this, the aforementioned manipulated variable $Y_S$ is compared with the calculated with the minimal limit value $Y_{limit\ min}$ (first limit value) which represents the minimum allowed rotational speed. The calculation is made on the basis of the functional relationship described in the first exemplary embodiment. The manipulated variable $Y_S$ falls below the minimum allowed limit value $Y_{limit\ min}$, i.e., the minimum allowed rotational speed, so a corrected manipulated variable $Y'_S$, which is transmitted instead of the manipulated variable $Y_S$ to the frequency converter, is then output by the first correction means 13.

The corrected manipulated variable $Y'_S$ preferably corresponds to the calculated minimum allowed limit value $Y_{limit\ min}$.

Third Example

The reference input variable W is a volume flow measured in L/min. The first actual operating parameter X is a measured volume flow. It is assumed that the volume flow demand increases during operation. In the example shown here, the reference input variable should double namely from 1500 L/min to 3000 L/min. The regulator 6 determines a manipulated variable $Y_S$, namely a rotational speed in this case, from the resulting control deviation W−X. This manipulated variable $Y_S$, i.e., the rotational speed preselected by the regulator 6 is compared by the comparator means 10 with a maximum allowed rotational speed, i.e., a first limit value $Y_{limit\ max}$. This maximum allowed rotational speed is determined on the basis of the $NPSH_{available}$, i.e., on the basis of the available NPSH and/or the holding pressure level of the system. In the exemplary embodiment shown here this amounts to 8 m $H_2O$ (meters of water column). Then $Y_{limit\ max}$, i.e., the maximum allowed rotational speed is determined on the basis of the $NPSH_{available}$ and another measured actual operating parameter, in this case the viscosity of the medium. This is done, for example, on the basis of the diagram shown in FIG. 4 or alternatively on the basis of a polynomial based on the following calculation principle and stored in a nonvolatile memory:

$$NPSH=f(\text{pump size}(d_a),\text{spindle angle of slope},\text{viscosity } \nu,\text{rotational speed } n)$$

which makes it possible to calculate the axial velocity of the medium within the pump, which is applicable for a certain design size and a certain angle of slope based on the pump size as a function of the spindle diameter $d_a$ and the spindle angle of slope, so that the following relationship is obtained in simplified terms:

$$NPSH=f(v_{ax\ size\ spindle\ slope\ angle},\text{viscosity } \nu,\text{rotational speed } n)$$

Consequently, it is true that $$v_{ax\ admissible\ size\ NPSH}=f(\nu,n)$$

so that by means of the relationship $$v_{ax}=S*n \text{ or } n=v_{ax}/S$$

ultimately the relationship $$Y_{limit\ max}=n_{admissible\ size\ NPSH}=v_{ax\ admissible\ size\ NPSH}/S$$

can be established.

Thus an admissible pump rotational speed $n_{admissible\ size\ NPSH}$ can be calculated for a pump of a certain pump size with a certain spindle angle of slope and a certain NPSH value.

In the diagram according to FIG. 4 the NPSH is shown on the left vertical ordinate in meters of water column (m $H_2O$). The right ordinate shows the rotational speed in revolutions per minute. The horizontal axis shows the axial velocity of the fluid in m/s. This diagram relates to an exemplary pump having a model size of 20 and an angle of slope of the spindle of 56°. The linear rise of the line characterizes the axial velocity $v_{ax}$ of the medium (delivery fluid) as a function of the rotational speed.

To determine the first limit $Y_{limit\ max}$, i.e., the maximum allowed rotational speed, it is necessary to move to the right in the diagram starting from an NPSH of 8 m $H_2O$ up to the curve which is characteristic of the measured viscosity of 500 $mm^2/s$. At the point of intersection with this curve, it is necessary to move upward in the diagram up to the linear line. At the point of intersection with this line, the maximum allowed rotational speed, i.e., the first limit value $Y_{limit\ max}$ can thus be read on the right ordinate. For the measured viscosity, i.e., the additional actual operating parameter, this amounts to approx. 3800 revolutions per minute.

As mentioned in the introduction, the reference input variable doubles, i.e., the required volume flow is doubled, which amounts to 3000 l/min from the assumed 1500 l/min, based on the linear relationships of a change in the manipulated variable. Since this manipulated variable $Y_S$ of 3000 l/min is smaller than the first limit value $Y_{limit\ max}$ of approx. 3800 l/min, the manipulated variable $Y_S$ can be transmitted to the frequency converter 4 as an input variable.

If the reference input variable were not only doubled but instead were tripled, for example, this would yield a manipulated variable of 4500 l/min, which would be larger than the first limit value $Y_{limit\ max}$ so that the correction means 13 would exceed the manipulated variable $Y_S$ stipulated by the regulator 6 by the amount of a corrected manipulated variable $Y'_S$, which would correspond to the first limit value, for example, i.e., 3800 l/min in the present example.

Exemplary Embodiment According to FIG. 7

The exemplary embodiment according to FIG. 7 differs from the exemplary embodiment according to FIG. 6 only in that the manipulated variable $Y_S$ generated by the regulator 6 is not compared with at least one first limit value representing and/or ensuring the positive displacement pump protection but instead is compared with one second limit value that ensures the delivery fluid quality. The exemplary embodiment presented here relates to a second limit value. In FIG. 7 the control means are again present as a control module that is separate from the drive module.

The at least one second limit value $Y_{limit\ max}$, $Y_{limit\ min}$ ensures that the delivery fluid quality is maintained. In the exemplary embodiment shown here, only a single maximum second limit value $Y_{limit\ max}$ is supplied by the second limit value specifying means 15, whereby as an alternative multiple second limit values, e.g., also a minimal limit value $Y_{limit\ min}$ which ensures the quality of the delivery fluid can also be calculated.

At any rate, the second comparator means 16 compare whether the manipulated variable $Y_S$ generated by the regulator 6 or a corrected manipulated variable already corrected in a previous additional correction procedure not covered here exceeds the second limit value $Y_{limit\ min}$ by a certain measure. If the manipulated variable $Y_S$ is less than or equal to the maximum limit value, then the manipulated variable $Y_S$ generated by the regulator 6 and/or supplied to the comparator means 16 is made available (calculated) as an input variable to the frequency converter 4.

Otherwise with the help of second correction means 18, comprising a second function unit 17 in addition to the second limit value specifying means 15, a corrected manipulated variable $Y'_S$ is made available with which the manipulated variable $Y_S$ is overwritten. To calculate the at least one second limit value $Y_{limit\ min}$, the second limit value specifying means 15 take into account the first actual operating parameter X on the basis of a functional relationship and also take into account at least one additional (other) actual operating parameter, for example, an auxiliary manipulated variable $Y_H$, an auxiliary control variable $X_H$ and/or a main manipulated variable $Y_{HH}$. For geometry parameters GP of the positive displacement pump and/or delivery fluid parameters FP as well as the vibration to be taken into account additionally in the calculation.

Fourth Example

The fourth example relates to the protection of the medium, i.e., the second limit value is determined so that no negative effect of a quality parameter of the delivery fluid conveyed with the positive displacement pump (delivery medium) results from the manipulated variable.

In the concrete example, there should be assurance that there is no unacceptable shearing in the delivery medium. The maximum allowed shearing rate of the medium therefore enters into the calculation of the second limit value. Again, a rotational speed regulation is to be implemented so that the second limit value corresponds to a maximum allowed rotational speed. This means that the first operating parameter X is a volume flow of the process system. In addition to the medium-specific limits to the maximum allowed shear rate, function factors of the pump enter into the determination of the second limit value, i.e., weight, velocity ratios are taken into account namely the difference in the angular velocity of the rotating displacement rotors (spindles) in comparison with the stationary pump housing. The velocity ratios in the gaps are directly proportionally dependent on the pump rotational speed and there is an inverse direct proportional relationship to the size of the function gap, i.e., to the respective current linear shear rate. This function gap is first of all dependent on the pump-specific conditions namely on the prevailing actual radial gap, i.e., the fixed pump rotor radial gap and also the current operating conditions namely the respective current pressure load on the delivery fluid as well as the respective prevailing viscosity of the delivery fluid. The two latter additional actual operating parameters are measured and taken into account in the calculation of the second limit value $Y_{limit\ max}$, i.e., in the calculation of the maximum allowed rotational speed.

Thus, for example, a delivery fluid with a dynamic viscosity $\eta$ of 5 Pas is pumped. This corresponds to a kinematic viscosity v of 5000 $mm^2/s$, such that with an assumed density $\rho$ of 1000 $kg/m^3$ a maximum allowed shear rate $D_{admissible}$ of 20,000 $sec^{-1}$ is obtained for the delivery fluid in a certain pump while maintaining the maximum allowed shear stress $\tau$ of 100,000 $N/m^2$. This is characterized by a rotary diameter of $D_a$=70 mm and by a radial gap $S=h_0$, which depends on the differential pressure, yielding a value of 0.021 mm at $\Delta p$=5 bar. This yields a maximum allowed rotational speed, i.e., a second limit value $Y_{limit\ max}$ of 191 l/min. As long as the manipulated variable $Y_S$ preselected by the regulator 6 is below the aforementioned value, the manipulated variable $Y_S$ can be forwarded directly to the frequency converter 4—otherwise, the manipulated variable $Y_S$ is overwritten by a manipulated variable $Y''_S$ that is corrected and/or limited by second correction means 18.

The example described above is based on the following computation principles:

It follows from $$\text{e.g., } \tau_{admissible}=D^*\eta \text{ and } \eta=\nu^*\rho \text{ for Newtonian fluids that}$$

$$D_{admissible}=\tau_{admissible}/(\nu^*\rho)$$

In addition, it holds that $$n_{admissible}=W_{admissible}/(D_a^*\pi^*60).$$

By inserting this into $$W_{admissible}=D_{admissible}^*S \text{ and/or into } D_{admissible}=\Delta W_{admissible}/S$$

and by combining all the constants that occur in k, the maximum allowed rotational speed can be calculated as follows:

$$D_{admissible}=(D_a^*\pi^*n)/(k^*S)\rightarrow n_{admissible}=(D_{admissible}^*k^*S)/(D_a^*\pi)$$

The maximum allowed rotational therefore corresponds to the limit value $Y_{limit\ max}$.

For the case when the delivery fluid (medium) to be pumped does not have Newtonian behavior, first the Reynolds number in the pump function gap, the shear rate and the resulting representative viscosities must be calculated according to known physical relationships for intrinsically viscous delivery fluids. In this way, the allowed relationships for these fluids can be monitored and maintained in the same way as in the case of Newtonian delivery fluids.

Exemplary Embodiment According to FIG. 8

The exemplary embodiment according to FIG. 8 negates the exemplary embodiments according to FIG. 6 and FIG. 7, i.e., the control means 5 are designed so that the manipulated variable $Y_S$ output by the regulator 6 can be compared with at least one first limit value (pump protection limit value) as well as with at least one second limit value (medium protection limit value). In the exemplary embodiment presented according to FIG. 3, the manipulated variable $Y_S$ generated by the regulator 6 is first compared with a first limit value and then with a second limit value, but the reverse order may of course also be implemented, i.e., by comparing the manipulated variable first with a second limit value and then with a first limit value.

It is characteristic of the exemplary embodiment according to FIG. 8 that the output value of the first comparison forms the input variable for the second comparison where the output variable of the first comparison cannot be the corrected manipulated variable $Y_S$, namely when there is nothing going beyond the limit value in the first comparison and thus $Y_S$ is not corrected, or alternatively, when it is a manipulated variable $Y'_S$ corrected by the first comparator means 10.

$Y_S$ or $Y'_S$ is then the input variable for the second comparator means 16. If no correction is performed here, the input value for the second comparison $Y_S$ or $Y'_S$ is sent to the frequency converter 4 or in the case of a correction the corrected manipulated variable $Y''_S$ is sent to the frequency converter.

In the exemplary embodiment presented here, the first and second decision means 20, 21 are provided. These decision means determine whether a pump protection comparison and/or a medium protection comparison is to be performed. The respective decision can be predefined in the software, for example, so that as an alternative the user need only perform a pump protection comparison or a medium protection comparison or may perform both comparison operations.

Figure 10:
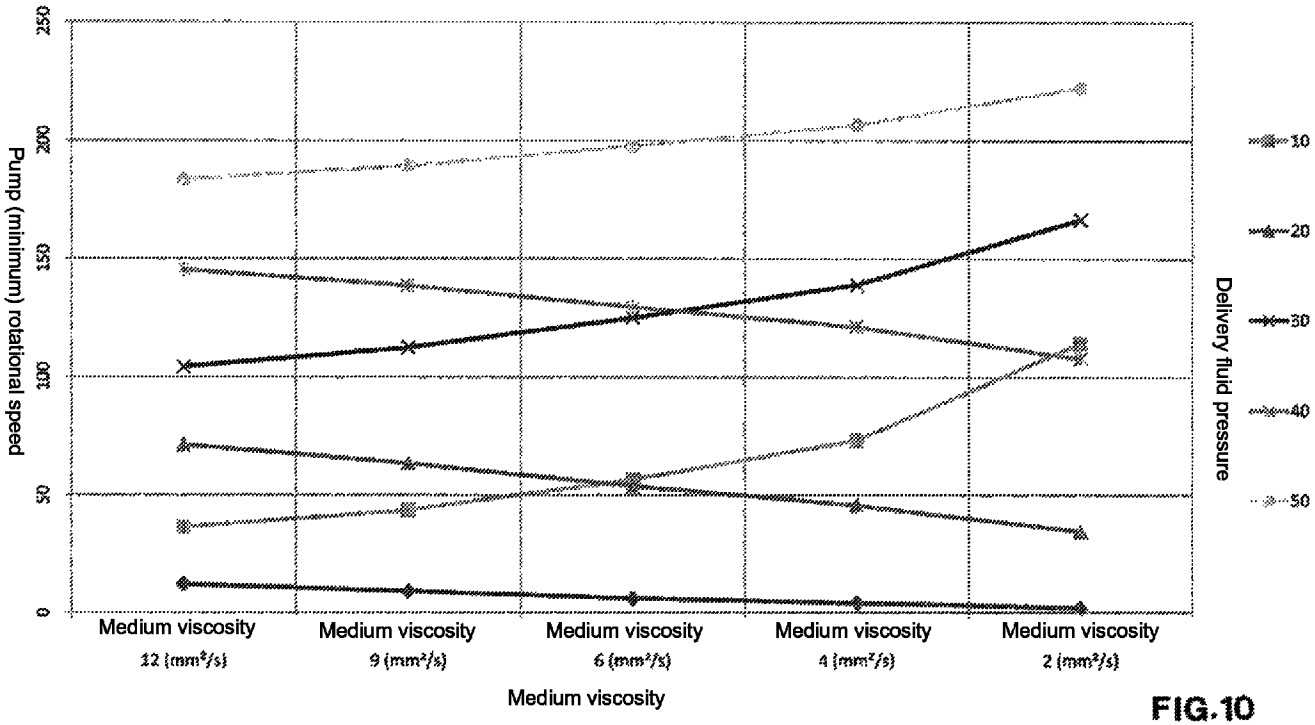

Exemplary Embodiment According to FIG. 10

This exemplary embodiment is a protected exemplary embodiment for implementation of pump protection. The manipulated variable is a rotational speed signal for the pump, where the pump rotational speed is plotted on the left ordinate in the diagram. The delivery pressure measured at the pressure connection of the pump enters into the calculation of the first limit value as the first actual operating parameter, with the delivery fluid pressure being plotted on the right ordinate. The delivery fluid viscosity (medium viscosity) enters into the calculation of the first limit value as an additional actual operating parameter, wherein the medium viscosity is plotted on the horizontal lower axis. Alternatively, the delivery fluid volume flow and/or the pump rotational speed or the delivery fluid pressure is considered here as the reference input variables. In the concrete exemplary embodiment, it is assumed that the delivery fluid pressure is the reference input variable.

In the example shown here, it is assumed that the delivery fluid viscosity (medium viscosity) drops from 12 $mm^2/s$ to 9 $mm^2/s$, to 6 $mm^2/s$, to 4 $mm^2/s$ and then (incrementally) to 2 $mm^2/s$ because of a corresponding change in medium. The delivery fluid volume flow may fluctuate. The reference input variable, i.e., the process pressure (delivery fluid pressure) should initially be kept at 10 bar, then at 20 bar, etc., i.e., it should increase incrementally by 10 bar at a time up to max. 50 bar. In other words, the reference input variable changes incrementally from 10 bar initially to 50 bar. The regular outputs a manipulated variable ($Y_S$) as a function of the reference input variable (W). The first limit value specifying means calculate a first limit value, which in the present case is a minimum rotational speed $Y_{limit\ min}$, as a function of the first actual operating parameter, which here is the delivery fluid pressure and in addition, the actual operating parameter which here is the medium viscosity such that in the concrete exemplary embodiment the medium viscosity is determined indirectly based on the delivery fluid temperature. In the present exemplary embodiment, failure to conform to the first limit value, i.e., the minimum rotational speed would have resulted in a defect status of the positive displacement pump. The comparator means in the concrete exemplary embodiment compare the manipulated variable preselected by the regulator, i.e., a rotational speed signal, with the first limit value calculated by the first limit value specifying means. If the manipulated variable in the exemplary embodiment presented here is above this first limit value, then the manipulated variable is forwarded to the frequency converter as an input signal. If the manipulated variable falls below the first limit value, then in the exemplary embodiment presented here a corrected manipulated variable is ascertained and/or determined as the input variable and is forwarded to the frequency converter where the first limit value determined by the limit value specifying means is forwarded as a corrected manipulated variable from the first correction means in the exemplary embodiment presented here.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are in the tended to fall within the scope of the present disclosure. Furthermore, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Thus, the claims set forth below should be construed in view of the full breadth and spirit of the present disclosure as described herein.

The invention claimed is:

1. A positive displacement pump system, comprising:

a positive displacement pump module;

a drive module separately replaceable with respect to the positive displacement pump module, the drive module including an electric drive motor and a frequency converter for regulating or controlling a drive motor rotational speed;

control means having a regulator for generating a manipulated variable (YS) as a function of a reference input variable (W) and a first actual operating parameter (X) independent of the frequency converter, the manipulated variable (YS) being receivable by the frequency converter via logic means associated with the regulator, such that the manipulated variable (YS) is convertible by the frequency converter of the drive module through a corresponding energization of winding into the drive motor rotational speed; and reference input variable specifying means for supplying the reference input variable (W) for the control means, wherein the control means is provided in a control module that is separate from the drive module, wherein the drive module is replaceable separately from the control module, wherein the drive module does not have a regulator that is designed or triggered for generating the manipulated variable (YS);

wherein the logic means are configured to at least one of determine and signal a maintenance need of the positive displacement pump as a function of at least one of the first actual operating parameter (X), at least one additional actual operating parameter (XH, YH, YHH), and a parameter that is specific for the positive displacement pump assigned to the control means, and wherein the maintenance need is at least one of determinable and signalable by the logic means a period of time before the positive displacement pump requires maintenance.

2. The system according to claim 1, wherein the logic means has first limit value specifying means configured to determine at least one first limit value as a function of the first actual operating parameter (X), and the at least one additional actual operating parameter (XH, YH, YHH);

having first comparator means configured to determine the manipulated variable (YS) or a corrected manipulated variable (Y'S, Y"S), or to compare a comparative value determined according to a functional relationship from the manipulated variable (YS), or the corrected manipulated variable (Y'S, Y"S) with the at least one first limit value, having first correction means configured to output a corrected manipulated variable (Y'S, Y"S) in response to the first comparator means detecting that the manipulated variable exceeds or falls below the at least one first limit value a certain amount, the corrected manipulated variable corresponding to the first limit value is determined by the first limit value specifying means; and the logic means having second limit value specifying means designed to determine at least one second limit value as a function of the first actual operating parameter (X) and at least one additional actual operating parameter (XH, YH, YHH);

having second comparator means designed to compare the manipulated variable (YS), or a corrected manipulated variable (Y'S, Y"S), or a comparative value determined according to a functional relationship from the manipulated variable (YS) or the corrected manipulated variable (Y'S, Y"S) with the at least one second limit value, and having second correction means configured to output a corrected manipulated variable (Y'S, Y") in response to the second comparator means detecting that the manipulated variable exceeds or falls below at least one second limit value a certain amount to output the corrected manipulated variable (Y'S, Y" S), corresponding to the second limit value, determined by the second limit value specifying means.

3. The system according to claim 2, wherein the first actual operating parameter is a measured actual control variable (X) selected from the list consisting of an actual pressure, an actual pressure difference and an actual volume flow of the delivery fluid.

4. The system according to claim 2, wherein the at least one additional actual operating parameter comprises at least one of:

a measured actual control variable (X) selected from the list consisting of an actual pressure, an actual pressure difference and an actual volume flow of the delivery fluid;

a measured auxiliary manipulated variable (YH) calculated on the basis of the actual value or measured, the measured auxiliary manipulated variable (YH) comprising a rotational frequency setpoint value of the frequency converter or a torque setpoint value of the frequency converter;

a measured auxiliary control variable (XH) calculated on the basis of an actual value, the measured auxiliary control variable (XH) comprising a rotational speed of the positive displacement pump motor or a torque of the positive displacement pump motor; or a measured temperature, in particular a delivery fluid temperature or a storage temperature of the positive displacement pump;

a measured vibration value;

a measured or calculated delivery fluid viscosity; and a measured leakage rate.

5. The system according to claim 2, wherein the logic means comprises at least one comparative value determination means configured to determine on the basis of at least one of:

a functional relationship from the manipulated variable (YS);

the corrected manipulated variable (Y'S, Y"S); and the first and the at least one additional actual operating parameter (XH, YH, YHH) to determine the comparative value.

6. The system according to claim 5, wherein the comparative value determination means are configured to at least one of:

take into account the specific geometry parameters (GP) of a gap width or a spindle diameter which are specific to the positive displacement pump assigned to the control means and are stored in a memory within the context of the functional relationship; and take into account in particular the shear behavior of the delivery fluid from a delivery fluid parameter (FP) stored in a memory.

7. The system according to claim 2, wherein at least one of the first and second limit value specifying means are configured to:

determine at least one of the first and second limit values as a function of the at least one specific geometry parameter (GP) a gap width or a spindle diameter assigned to the control means and stored in a memory; or determine these values as a function of a delivery fluid parameter (FP) stored in a memory, wherein the delivery fluid parameter comprises the shear behavior of the delivery fluid; and wherein at least one of the first and second correction means are configured to determine the corrected manipulated variable (Y'S, Y"S) as a function of at least one specific geometry parameter (GP), a gap width and a spindle diameter that is specific for the positive displacement pump assigned to the control means and stored in a memory and/or as a function of a delivery fluid parameter (FP) stored in a memory.

8. The system according to claim 2, wherein at least one of the first and the second limit value specifying means are configured to determine at least one of the first and second limit values as a function of at least one of:

a minimal or maximal shear rate in the positive displacement pump stored in a memory and specific for the positive displacement pump assigned to the control means;

the first or second correction means are designed to determine the corrected manipulated variable (Y'S, Y"S) as a function of at least one shear rate in the positive displacement pump which is stored in a memory and is specific for the positive displacement pump assigned to the control means; and as a function of actual shear rate.

9. The system according to claim 2, wherein at least one of the first and second comparator means are configured to compare at least one of:

(1) the first actual operating parameter (X), (2) the at least one additional actual operating parameter (XH, YH, YHH), (3) a value calculated according to a functional relationship from the first actual operating parameter (X), (4) the at least one additional actual operating parameter (XH, YH, YHH), (5) a manipulated variable (YS) of the regulator, (6) a corrected manipulated variable, (7) a comparative value calculated on the basis of the manipulated variable (YS), and (8) the corrected manipulated variable (Y'S, Y" S), with at least one limit value stored in a memory of the logic means, and the first and/or second correction means are designed to output a corrected manipulated variable (Y'S, Y"S) when the first comparator means detects that the at least one defined limit value goes beyond the first limit value.

10. The system according to claim 2, wherein in a nonvolatile memory, in particular and EEPROM of the control means, at least one of different system parameter data records for different positive displacement pumps and different delivery fluid parameters (FP) are stored so they can be selected manually, in particular by means of a selection menu.

11. The system according to claim 2, wherein the control means is configured for communicating via a bus system.

12. The system according to claim 2, wherein the control means has memory means for storing at least one of the first actual operating parameters (X), the at least one additional operating parameter (XH, YH, YHH), the reference input variables (W), the comparative values, and the limit values, each with a time stamp.

13. The system according to claim 2, wherein input means in the form of at least one key are provided for configuration of the control means.

14. The system according to claim 2, wherein the reference input variable specifying means comprise a process control room configured for at least one of monitoring, controlling and regulating a plurality of system units, in particular positive displacement pump.

15. The system according to claim 2, wherein the control means is configured to communicate with at least one of the process control room and a plurality of control means to communicate among one another via a CAN bus system.

16. The system according to claim 2, wherein the control means have a signal-conducting connection to a sensor for receiving at least one of the first actual operating parameter (X) and at least one additional measured actual operating parameter (XH, YH, YHH) and wherein the control means have a signal-conducting connection for the frequency converter to receive at least one of the first actual operating parameter (X) and the at least one additional measured actual operating parameter (XH, YH, YHH); wherein the additional measure actual operating parameter is selected from the list consisting of a positive displacement pump motor rotational speed, a rotational frequency setpoint value of the frequency converter, and a torque setpoint value of the frequency converter.

17. The system according to claim 2, wherein the regulator of the control module is a PI regulator or a PID regulator.

18. The system according to claim 2, wherein a a first control module and a second control module are connected to the bus system, each of said first and second control modules being assigned to the drive module and the pump module.

19. The system according to claim 18, wherein signaling means include at least one of a display and an LED lamp, the signaling means disposed only on the first control module.

20. The system according to claim 2, wherein the control module comprises signaling means, the signaling means comprising visualization means for signaling at least one of interference, necessary maintenance, and other information.

* * * * *